United States Patent [19]

Csont

[11] Patent Number: 4,943,336

[45] Date of Patent: Jul. 24, 1990

[54] APPARATUS AND METHOD FOR FABRICATING COMPOSITE PANELS FOR USE IN CONCRETE BUILDINGS

[76] Inventor: Ernest Csont, 4133 Quando Dr., Belle Isle, Fla. 32812

[21] Appl. No.: 212,014

[22] Filed: Aug. 18, 1988

[51] Int. Cl.[5] ..... B32B 31/00

[52] U.S. Cl. ..... 156/280; 29/467; 52/309.14; 52/309.17; 52/745; 52/749; 156/91; 156/182; 156/304.1; 156/312; 249/18; 269/289 R

[58] Field of Search ..... 156/91, 280, 182, 312, 156/304.1; 29/467; 52/309.4, 309.17, 745, 749; 249/18; 269/289 R

[56] References Cited

U.S. PATENT DOCUMENTS

| | | | |
|---|---|---|---|
| 1,060,914 | 5/1913 | Lillow . | |
| 1,740,958 | 12/1929 | Pitou . | |
| 2,556,611 | 6/1951 | Borgman . | |
| 3,047,931 | 8/1962 | Boettner . | |
| 3,071,206 | 1/1963 | Kristen . | |
| 3,881,714 | 5/1975 | Wilnau | 52/947 |
| 3,940,105 | 2/1976 | Metrailer . | |
| 4,015,395 | 4/1977 | Gostling . | |
| 4,067,758 | 1/1978 | Sommer | 156/280 |
| 4,078,759 | 3/1978 | Lanier . | |
| 4,123,032 | 10/1978 | Teschner . | |
| 4,246,060 | 1/1984 | Csont . | |
| 4,248,024 | 2/1984 | Dahlstrom . | |
| 4,742,986 | 5/1988 | Csont . | |

FOREIGN PATENT DOCUMENTS

| | | | |
|---|---|---|---|
| 2019044 | 11/1970 | Fed. Rep. of Germany . | |
| 1094574 | 12/1967 | United Kingdom | 52/745 |

*Primary Examiner*—John J. Gallagher
*Attorney, Agent, or Firm*—James H. Beusse

[57] ABSTRACT

A panel fixture is provided for receiving insulative blocks and trusses for facilitating fabrication of modular building panels. The fixture includes a main beam to which first and second rows of staves are mounted via respective first and second U-channel members. The rows of staves accept insulative blocks and trusses therebetween in alternating block/truss, block/truss fashion. Multiple geometry building structures are possible using the disclosed fixture alone or in combination with fixtures having multiple sub-fixtures.

13 Claims, 23 Drawing Sheets

APPARATUS AND METHOD FOR FABRICATING COMPOSITE PANELS FOR USE IN CONCRETE BUILDINGS

BACKGROUND OF THE INVENTION

This invention relates in general to concrete buildings and, more particularly, to an apparatus and method for producing panels employed in constructing such concrete buildings.

Concrete has long been a building material of choice due the substantial structural integrity which it affords. In recent years, various techniques and apparatus have been developed and used in the construction industry for the fabrication of modular concrete buildings. Buildings constructed with most of these devices require substantial labor, a significant portion of which is relatively skilled. Many of these techniques for constructing modular concrete structures involve the erection of relatively massive collapsible forms which are assembled and disassembled within the concrete structure. In several of these prior approaches, substantial time is required for the assembly and disassembly of the concrete forms. The attendant labor cost of this time represents a substantial portion of the overall cost of this type of modular concrete construction.

My U.S. Pat. No. 4,426,060 discloses an apparatus and method for constructing a modular concrete shell housing unit which requires very little skilled labor. Although the invention in that patent significantly reduces the labor and cost of constructing modular housing units, the size and shape of the building to be constructed is limited to the size and shape of the apparatus itself.

Although concrete is an excellent building material, by itself it has relatively poor insulative properties. Building systems have been developed in which the structural strength of concrete and reinforcing wire have been combined with the insulative properties of lightweight insulative foam materials. For example, some contemporary building systems employ three dimensional wire matrix panels such as those shown in FIG. 1, which are attached to the outside of a framing structure arranged in the desired size and shape of a building to be constructed. The wire matrix panel in FIG. 1 has a polyurethane foam insulation core 12 with a wire matrix 14 protruding from both faces of core 12. Once the panels are positioned on the framing structure, fluent concrete 16 or the like, is then introduced to the outside faces of wire matrix panel thus forming a reinforced concrete structure. Insulative foam, such as that employed in the above wire matrix panel, has relatively low structural strength. However, the combined concrete/insulative foam structure in this reinforced concrete panel has both high structural integrity and high insulative properties.

One framing structure which may be employed to temporarily support panels such as those discussed above is described and claimed in my patent application, U.S. Pat. No. 4,742,986, issued May 10, 1988, entitled "Apparatus for Constructing Concrete Buildings", the disclosure of which is incorporated herein by reference.

The panels described above are pre-fabricated, that is, they are built at a location removed from the construction site. Considerable labor and expense are involved in transporting such panels to the construction site. Moreover, if a panel is found to be defective in some manner, either a replacement must be provided from a supply of extra panels which is maintained on site or a replacement panel must be shipped from a remote storage facility to the construction site.

BRIEF SUMMARY OF THE INVENTION

One object of the present invention is to provide an apparatus and method for fabricating panels at the construction site as opposed to shipping panels from a remote location.

Another object of the present invention is to provide an apparatus and method for both fabricating such panels and placing such panels in position in the building to be constructed.

In accordance with one embodiment of the present invention, a fixture apparatus for assembling composite concrete panels is provided including a base member having a lateral dimension. A first row of staves is situated in spaced apart relationship and is mounted to the base member along the lateral dimension thereof. The staves of the first row extend away from the base member. A second row of staves is situated in spaced apart relationship and is mounted to the base member along the lateral dimension thereof. The staves of the second row extend away from the base member and are oriented generally parallel with and spaced apart from the staves of said first row. Thus, the fixture is capable of engaging insulative blocks between the first and second rows of staves.

One embodiment of the fixture includes a first mounting member, attached to the base member and the first row of staves, for movably mounting the first row of staves with respect to the base member. The fixture further includes a second mounting member, attached to the base member and the second row of staves, for movably mounting the second row of staves with respect to the base member. In this manner, the first and second rows of staves are movable closer together to accommodate insulative blocks therebetween having smaller lateral thickness. The first and second rows of staves are also movable farther apart to accommodate insulative blocks therebetween having larger lateral thickness.

The invention also includes, in one form, a method for fabricating a composite concrete panel in a fixture having a first row of spaced apart staves attached to a base member and a second row of spaced apart staves attached to the base member, the first row being substantially parallel with the second row. In the fixture used in the method, an insulative block receiving region is formed above the base member and between the first and second rows. The method includes the steps of placing a block of insulative material in the block receiving region and situating a truss in the block receiving region of the fixture above the block. The truss includes parallel stringer members connected together by a plurality of cross members, the stringer members of the truss being situated outside of the first and second row of staves. The method further includes the steps of applying adhesive to the block. The placing, situating and applying steps are repeated until nearly the desired panel height is achieved. The method continues with placing a block of insulative material in the block receiving region to position the uppermost block of the panel and form the top of the panel, the bottom of the panel thus being formed at the lowermost block thereof. The panel thus formed includes first and second opposed major surfaces. The method includes mounting first and second wire mesh sheets on the first and second major surfaces of the panel, respectively, the first and second wire mesh sheets being substantially flush with the bottom of the panel and extending beyond the top of the panel to permit overlap with other panels. The first and second wire mesh sheets are mounted to the stringer members of the trusses in the panel. The method further includes moving the panel formed according to the above steps into position in a building under construction and removing the fixture from the panel. The method further includes the step of applying fluent concrete to the panel formed according to the above steps.

The features of the invention believed to be novel are specifically set forth in the appended claims. However, the invention itself, both as to its structure and method of operation, may best be understood by referring to the following description and accompanying drawings.

DETAILED DESCRIPTION OF THE INVENTION

Figure 2:
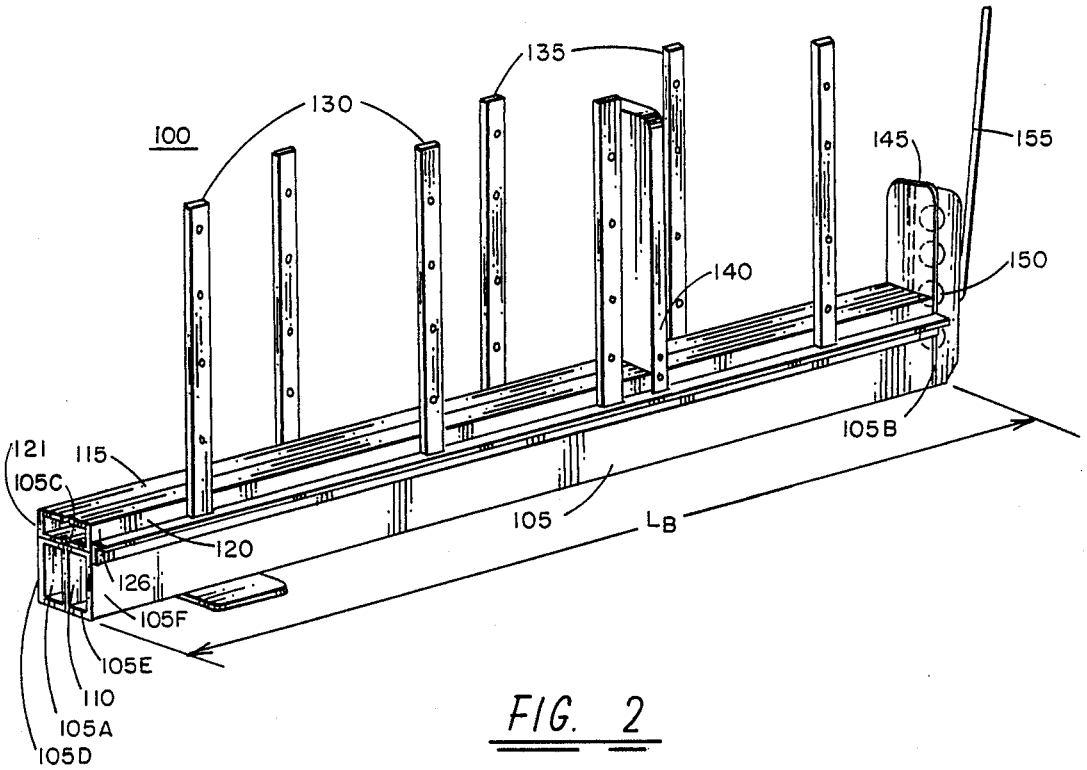
FIG. 2 is a side perspective view of the panel fixture apparatus of the present invention.

FIG. 2 shows a side perspective view of a panel fabrication fixture in one form of the present invention as fixture 100. Fixture 100 includes a beam 105 which forms the base of fixture 100. Beam 105 exhibits a generally rectangular cross section and includes opposed ends 105A and 105B. Beam 105 includes side surfaces 105C, 105D, 105E and 105F and exhibits a length, LB, which, in one embodiment, is about thirty feet. Those skilled in the art will appreciate that this length given by way of example is not intended to be limiting since a fixture 100 of virtually any length may be fabricated to provide for the maximum panel length that may be required for a particular building application. In the particular embodiment of the invention shown in FIG. 2, a reinforcing member 110 is situated within beam 105 between upper side 105C and lower side 105E and running from end 105A to end 105B as shown.

Figure 3:
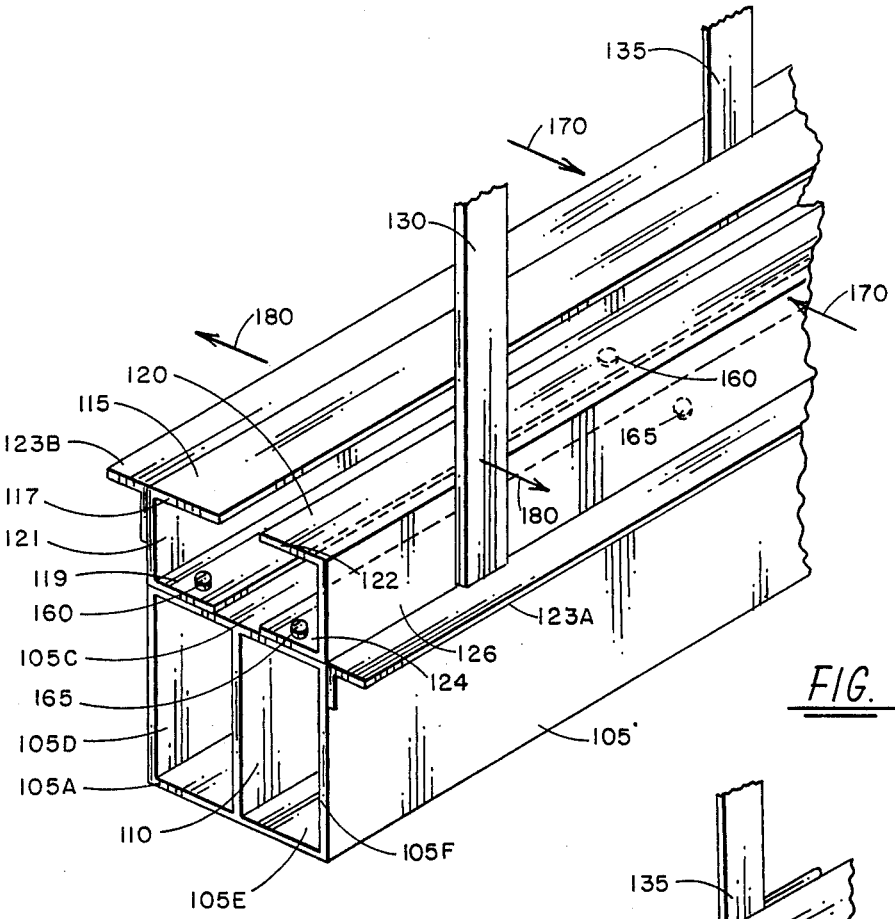
FIG. 3 is a close-up side perspective view of an end portion of the panel fixture of FIG. 2.

As seen in FIG. 2 and more clearly in the close-up perspective view of an end portion of fixture 100 in FIG. 3, fixture 100 includes U-channel members 115 and 120 situated on upper beam surface 105C. Members 115 and 120 are situated adjacent side surfaces 105D and 105F, respectively. U-channel member 115 includes arms 117 and 119 which are each joined to a side 121 which together form the U-shaped geometry of member 115. U-channel member 120 includes arms 122 and 124 which are each joined to a side 126 which together form the U-shaped geometry of member 120. U-channel members 115 and 120 are oriented on beam surface 105C such that arms 119 and 124 abut beam surface 105C. Arms 117 and 122 face inwardly toward each other and arms 119 and 124 face inwardly toward each other as seen in FIG. 3. As will be apparent, the beam 105 provides a support for the U-channel members 115, 120 and is used in this embodiment for added strength to allow for mobility of the fixture in a manner to be explained hereinafter. Other supports could be used for stationary fixtures or where such excess strength is not required.

A plurality of staves 130 is mounted on U-channel side 126 as shown in FIG. 2. Staves 130 are positioned in spaced apart relationship and are oriented substantially perpendicular to beam 105. A plurality of staves 135 is also mounted on U-channel side 121 as shown in FIG. 2. Staves 135 are positioned in spaced apart relationship and are oriented substantially perpendicular to beam 105. Staves 130 and staves 135 form a workspace into which insulative foam blocks are positioned as described later.

Fixture 100 includes a variable position panel end piece 140 which has a height approximately the same as the height of staves 130 and 135. End piece 140 may be bolted or otherwise mounted in position at virtually any location along the length of U-channel members 115, 120 according to the particular length of panel desired to be fabricated. End piece 140 is oriented substantially parallel to beam 105 and provides a surface against which one end of a panel (not shown) will abut as later described.

A hoist attachment member 145 is connected to beam end 105B such that when fabrication of a panel in fixture 100 is complete, fixture 100 and the completed panel can be hoisted and moved into the desired position in the building under construction. Hoist attachment member 145 includes a plurality of holes 150 into which a hoisting rope 155 can be tied or otherwise connected.

FIG. 3 is a close-up view of the end of fixture 100 adjacent beam end 105A. One stave of each of the rows of staves 130 and 135 is shown for illustration purposes. A plurality of bolts 160 is situated along the length of U-channel side surface 119 to mount U-channel member 115 to upper beam surface 105C as shown. Similarly, a plurality of bolts 165 is situated along the length of U-channel side surface 124 to mount U-channel member 120 to upper beam surface 105C. The width or spacing between U-channel members 115 and 120 (and the respective rows of staves 130 and 135 which they support) can be varied according to positions on upper surface 105C selected for placement of bolts 160 and bolts 165. That is, to fabricate panels of lesser thickness, U-channel members 115 and 120 can be moved closer to each other in the direction of arrows 170 until the desired thickness is reached. Alternatively, to fabricate panels of greater thickness, U-channel members 115 and 120 can be moved further away from each other in the direction of arrows 180 until the desired thickness is reached. To facilitate inward and outward adjustment of U-channel members 115 and 120 to accommodate various thickness panels, a slot (not shown) oriented parallel with direction 170 and 180 may be cut at each bolt location on U-channel arms 119 and 121. Note also that angle iron pieces 123A and 123B are attached to the sides of the fixture. The pieces 123 are used to support and align wire mesh sheets to be attached to the panels.

Figure 4:
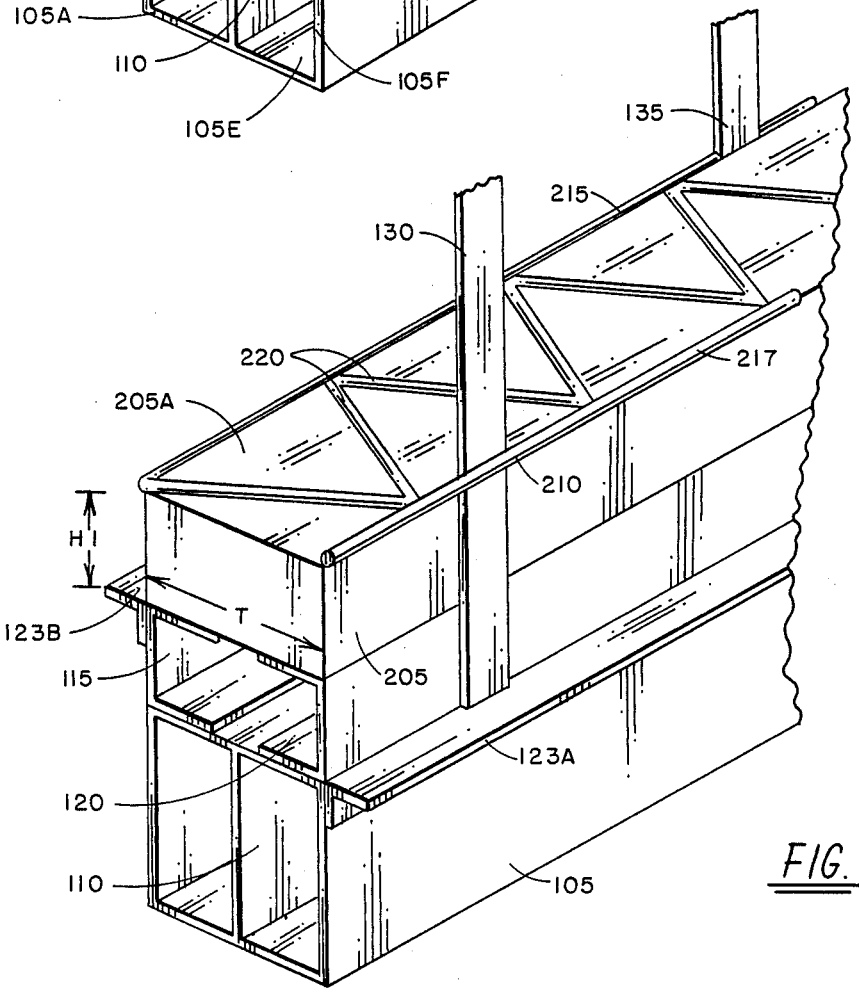
FIG. 4 is a side perspective of the panel fixture of FIG. 3 shown with an insulative block and truss therein.

Referring now to FIG. 4, to fabricate a panel using fixture 100, a block 205 of insulative foam material is situated on and above U-channel members 115 and 120 as shown. Block 205 is positioned between rows of staves 130 and 135. For example, the insulative foam material such as foamed synthetic resins or expanded foam materials such as polystyrenes, polyurethanes and the like may be employed as the material of block 205. Other relatively lightweight insulative materials may be used as blocks 205 as well. Foam block 205 is defined to a have a height, H1. For convenience, a height H1 of six inches is selected for this example; however, those skilled the art will appreciate that other heights H1 of block 205 may be employed as well as will be discussed in more detail subsequently. The lateral thickness of insulative block 205 is defined to be T which accounts for most of the thickness of the panel. A truss 210 is positioned on block 205 as shown in FIG. 4. Truss 210 includes substantially parallel stringers 215 and 217 which are rod-like members forming the opposite sides of the truss. Truss 210 further includes welded cross members 220 running from side to side from stringer 215 on one side of truss 190 to stringer 217 on the other side of truss 210. Stringers 215 and 217 and cross members 220 together form a series of triangles along the length of truss 210 as seen in FIG. 4. When truss 210 is placed in fixture 100, stringers 215 and 217 are positioned, respectively, outside of row of staves 130 and row of staves 135. Truss 210 is fabricated from relatively heavy gauge rod materials, for example ¼ inch stock. Those skilled in the art will appreciate that rod stock of other gauges than in this example above will perform satisfactorily as well depending on the particular application.

To continue fabrication of the panel in fixture 100, an adhesive, for example, liquid polystyrene, is then sprayed or otherwise deposited on the upper surface 205A of block 205. Now referring to FIG. 5, a block 225 of insulative material is situated on top of the truss 210 situated on top of block 205 such that the bottom of block 225 adheres via the adhesive to the top of block 205.

Figure 6:
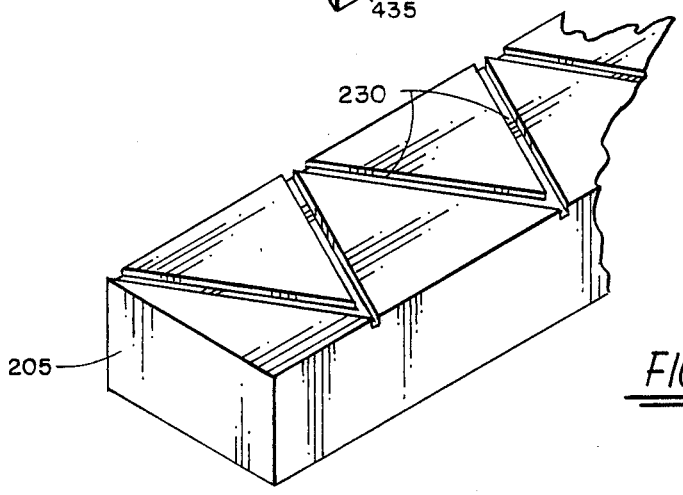
FIG. 6 is a perspective view of an end portion of an insulative block having channels situated therein for receiving a truss.

It is noted that where trusses 210 contact blocks 205 and 225, channels 230 for receiving trusses 190 are formed in such blocks to permit blocks 205 and 225 to abut each other in a flush relationship. These channels 230 are obscured from view in the above drawings by the trusses 210 themselves. However, the close-up view of an end portion of block 205 shown in FIG. 6 illustrates these truss receiving channels 215. Both the upper and lower surfaces of blocks 205 and 225 where trusses 210 contact blocks 205 or 225 are outfitted with channels 230 to permit the aforementioned flush mating of blocks 205 and 225 when such blocks are stackably arranged in fixture 100 in accordance with the invention. The sprayed adhesive layer (not shown) situated between stacked blocks 205 and 225 thus bonds blocks 205 and 225 together and simultaneously provides a moisture barrier for the fabricated panel.

Block 225 exhibits a height H2 which is approximately twice the height H1 of block 205. The height of block 225 determines the center to center distance between trusses 210 and of course may be selected to have values other than those given above. That is, if the panel is desired to have more structural strength, then the center to center distance between the trusses, H2, is decreased. However, if in a particular application, less structural integrity is acceptable in a panel, then the center to center distance, H2, between the trusses may be increased.

Figure 5:
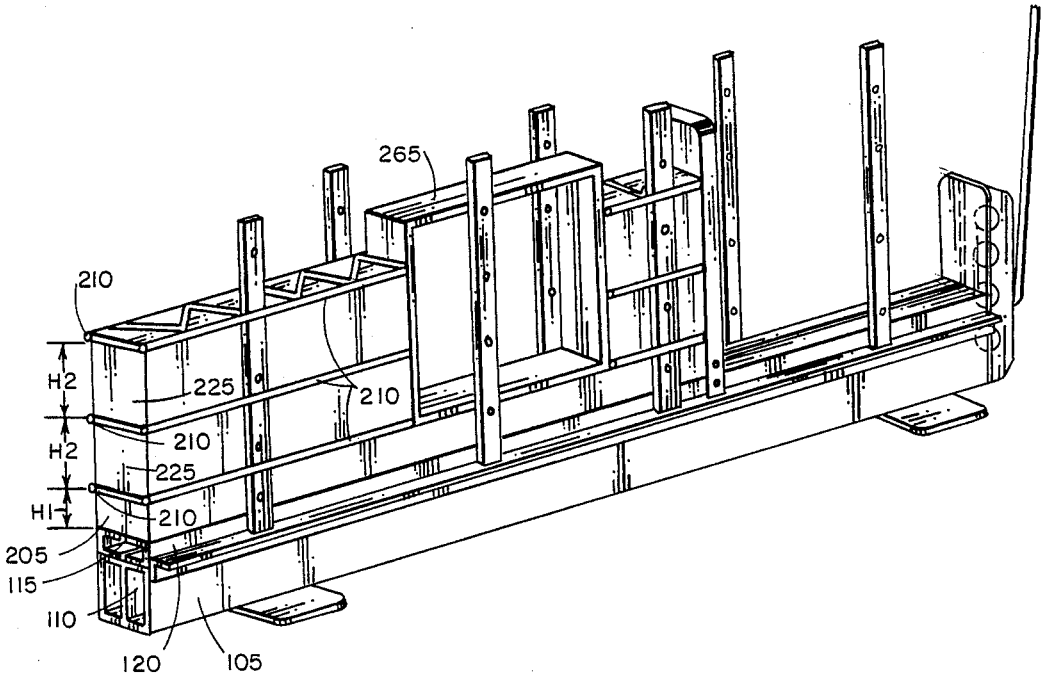
FIG. 5 is a side perspective view of the panel fixture of FIG. 2 shown with insulative blocks and trusses situated therein to form a building panel.

Another truss 210 is situated on top of the lowermost block 225 as seen in the uppermost portion of FIG. 5. Stringers 215 and 217 of such truss 210 on top of lowermost block 225 are again situated outside of rows of staves 130 and 135. The top surface of each block 225 is sprayed or otherwise receives a deposit of adhesive in the same manner as that by which the top surface of block 205 received an adhesive earlier. The top surface of the lowermost block 225 is thus prepared to receive another insulative block thereon.

To continue further in fabricating the panel in fixture 100, subsequent layers of blocks 225, trusses 210 and adhesive are used to build up the panel by repeating the block-truss-adhesive sequence already described above. That is, second and third blocks 225 are stackably arranged in fixture 100 as shown in FIG. 5 above the lowermost block 225. Trusses 210 and adhesive are disposed between the blocks 225 as the panel is built up to nearly the desired height.

In one embodiment of the invention, the upper boundary 235 of the panel in fixture 100 is terminated by a block 205 substantially identical to the lower block 205 discussed earlier. That is, block 205 exhibits a height H1 equal to approximately one half of the height of blocks 225. In this manner, the center to center distance of trusses 210 is preserved across a boundary 235 (FIG. 7) where one panel meets another panel as will be seen subsequently. An adhesive layer may be placed at a panel boundary where one panel meets an adjacent panel. The panels formed in fixture 100 have an upper boundary 235 and a lower boundary 240. As will be seen later, when the panels are placed in position in the building under construction, the lower boundary 240 of one panel mates with the upper boundary 235 of the next adjacent panel.

Figure 7:
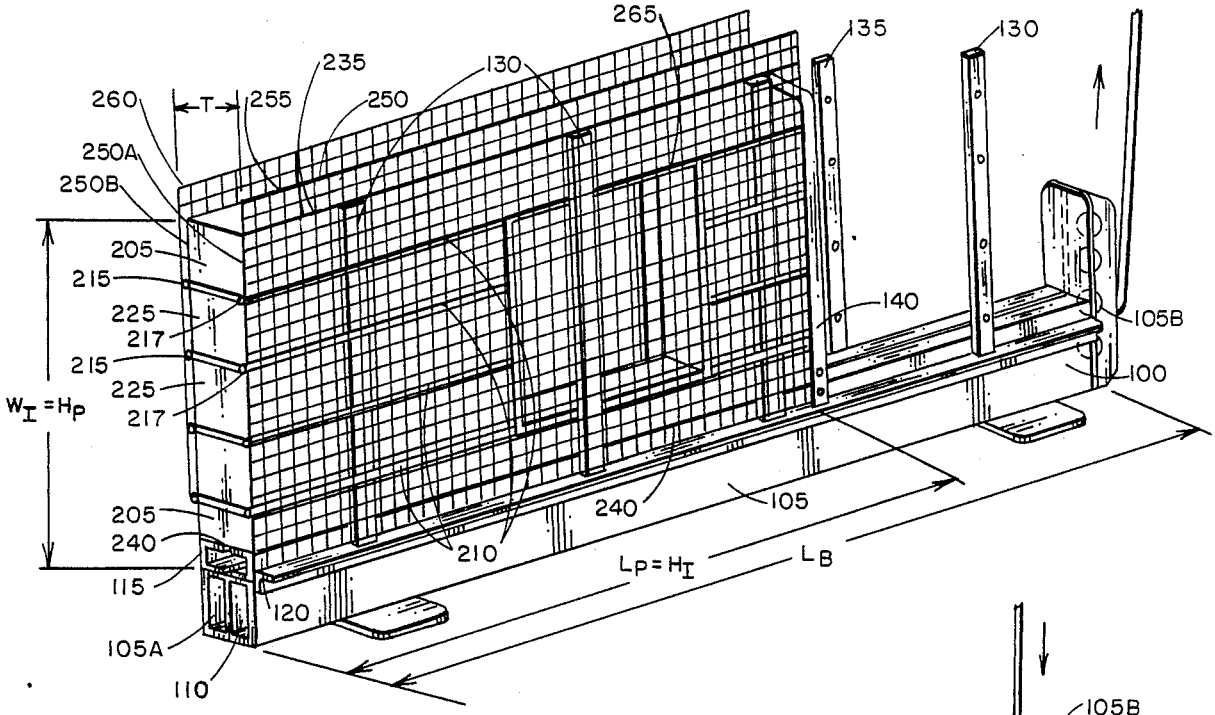
FIG. 7 is side perspective view of the panel fixture of FIG. 2 shown with a nearly completed panel therein.

When the panel is nearly completed as in FIG. 7, it can be seen that the panel, now designated panel 250, has front and back opposed major surfaces 250A and 250B. A wire mesh sheet 255 is situated over front surface 250A as shown. Wire mesh sheet 255 is mounted flush with lower boundary 240 and extends beyond upper boundary 235 by a sufficient distance to facilitate mating and connection with adjacent panels. Wire mesh sheet 255 has a length substantially equal to the preinstallation length LP of panel 250 as shown. Another wire mesh sheet 260 having approximately the same dimensions as sheet 255 is likewise mounted to back surface 250B. A preferred way of mounting wire mesh sheet 255 on panel surface 250A is to employ "hog clips" at locations where the wire mesh sheet 255 contacts stringer 217 of truss 210. Alternatively, the locations where wire mesh sheet 255 contacts stringer 217 may be welded or connected by other connecting devices. Similarly, wire mesh sheet 260 is mounted on panel surface 250B by using hog clips at locations where wire mesh sheet 260 contacts stringer 215 of truss 210.

It is noted that in the course of fabricating a panel such as panel 250, a window, door or other structure may be incorporated into such panel 250. For example, to provide for a window, a form 265, which approximates the desired shape and size of the window, is situated within panel 250 as shown in FIG. 5 and FIG. 7. Blocks 205 and 225 are cut to appropriate lengths to leave sufficient room for form 265. In this manner, space is provided in which the window or other structure can be mounted later. Ductwork (not shown) can also be incorporated into panel 250 by placing hollow tubes or the like within blocks 205 and 225 to provide space for such ducts whether they be electrical, plumbing, air conditioning or other ducts.

Figure 8:
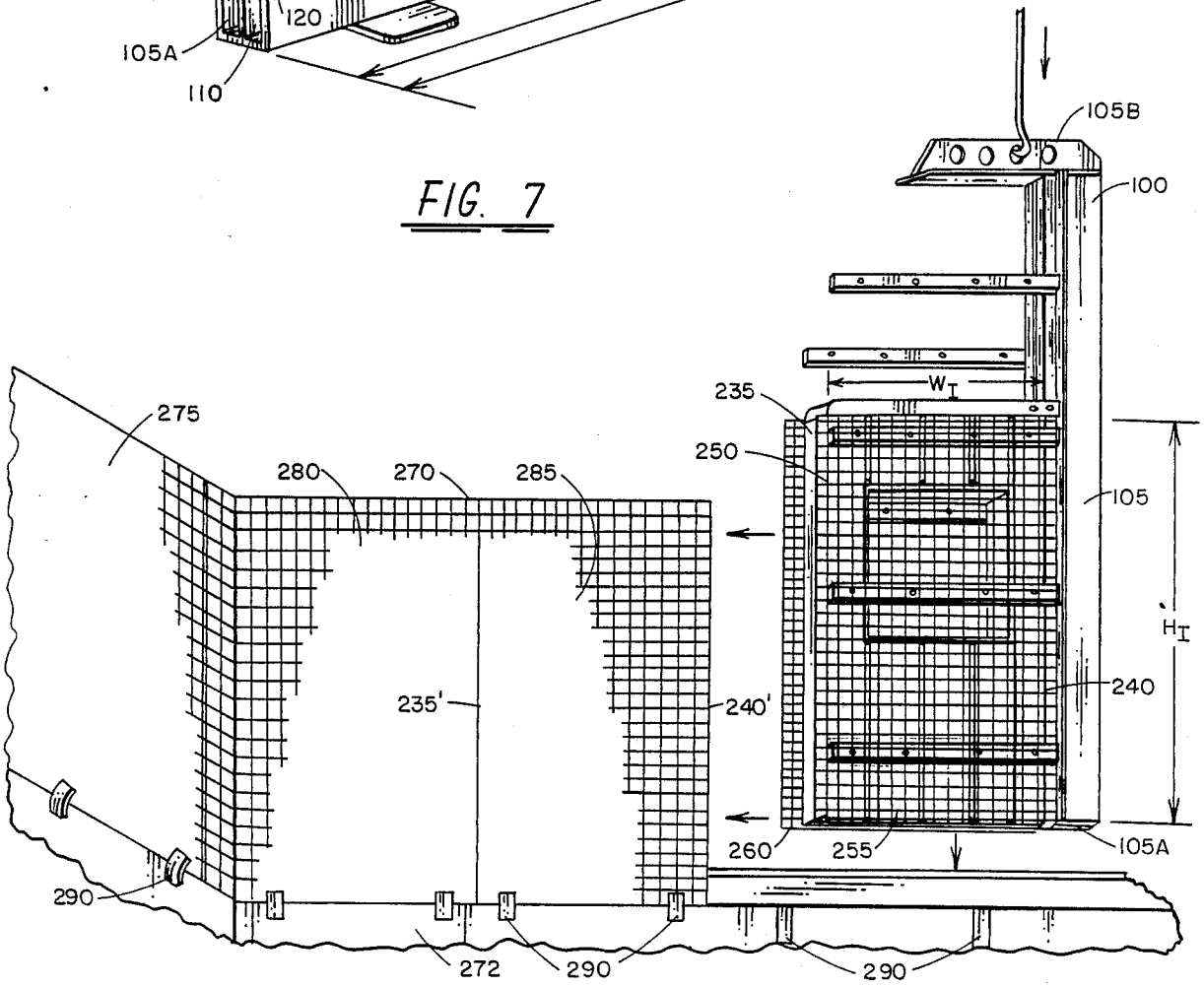
FIG. 8 is a perspective view of the panel fixture and panel being hoisted toward a modular building for placement therein.

Fixture 100 with the substantially complete panel 250 therein is hoisted upward at end 105B by a crane (not shown) or similar device. In so hoisting fixture 100, fixture 100 is rotated approximately 90 degrees from the horizontal (pre-installation) position shown in FIG. 7 to the vertical (installation) position shown in FIG. 8. When so hoisted and rotated, the preinstallation horizontal length LP dimension of panel 250 as seen in FIG. 7 becomes the installed vertical height dimension H of panel 250 as shown in FIG. 8. Similarly, the preinstallation total vertical height dimension HP becomes the installed horizontal width dimension, W.

FIG. 8 shows a partially constructed building 270 in which the now hoisted panel 250 is to be positioned. Building 270 is situated on a slab 272 which serves as the base of the building. Building 270 includes panels 275, 280 and 285 which have already been positioned in place on slab 272. Panels 275, 280 and 285 are held down to slab 272 by straps 290 or the like as shown in FIG. 8. A framing structure such as that shown in the aforementioned U.S. Pat. No. 4,742,986 (not shown) is also provided for supporting the panels in the manner described in that patent.

Figure 9:
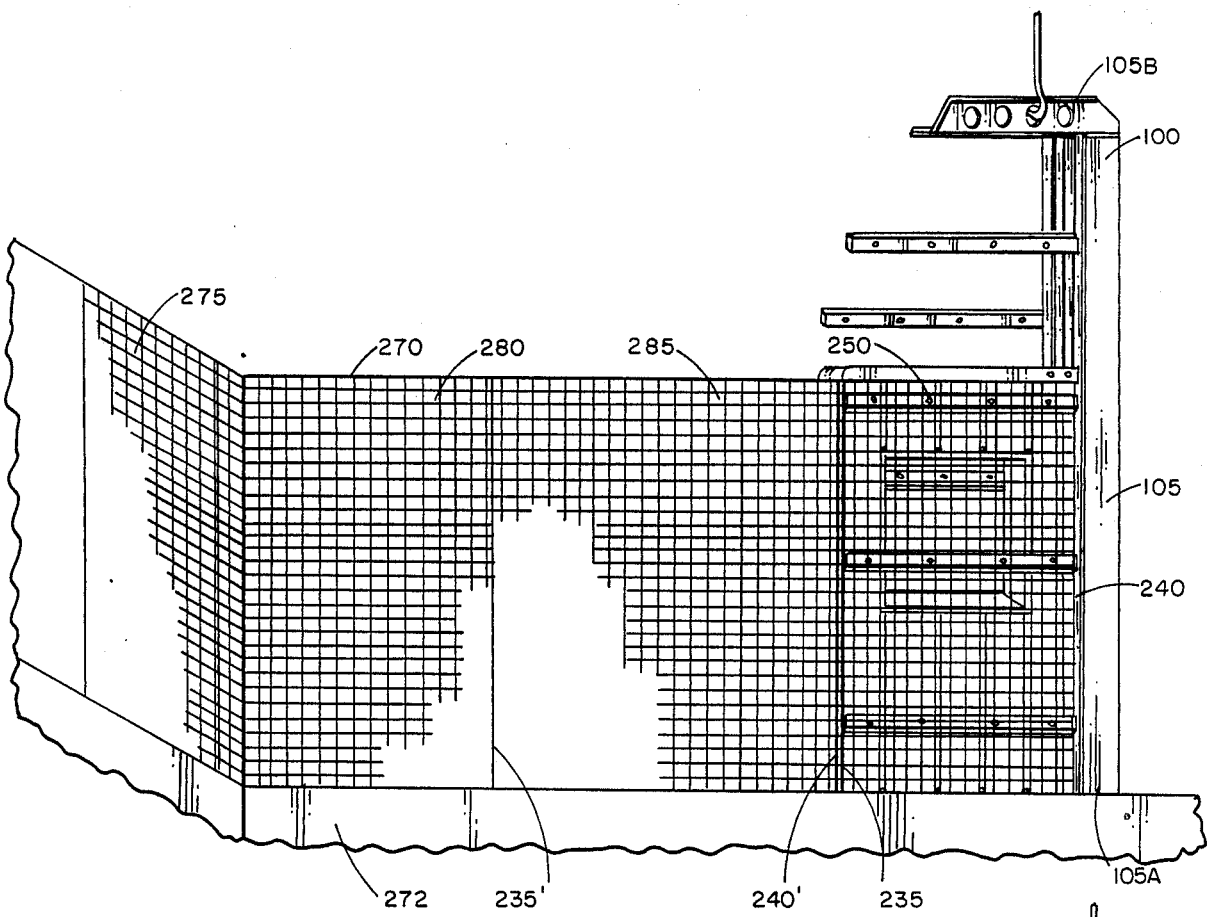
FIG. 9 is a perspective view of the panel fixture and panel aligned with other panels in the modular building which is under construction.

Fixture 100 with panel 250 therein is hoisted into substantial alignment with adjacent panel 285 as seen in FIG. 9. The bottom of panel 250, as seen more clearly in FIG. 8, is positioned on slab 290 and is connected to slab 290 by the above mentioned connecting straps 290. Returning again to FIG. 9, the "upper" boundary 235 of panel 250 is covered with adhesive and is abutted against adjacent panel 285. The portions of wire mesh sheets 255 and 260 (see FIGS. 8 and 9) which extend beyond boundaries 235 and 240 are positioned to overlap with the wire mesh sheets of adjacent panels, such as panel 285. It is noted that panel 285 is substantially the same as panel 250 and has a boundary 240' beyond which panel 285's outer wire mesh sheet extends and a boundary 235' at which panel 285's inner wire mesh sheet is flush. Thus, during installation, boundary 235 of panel 250 is abutted against boundary 240' of panel 285 and is sealed to boundary 240' by a layer of adhesive sprayed or otherwise deposited between boundary 235 of panel 250 and boundary 240' of panel 285.

Figure 10:
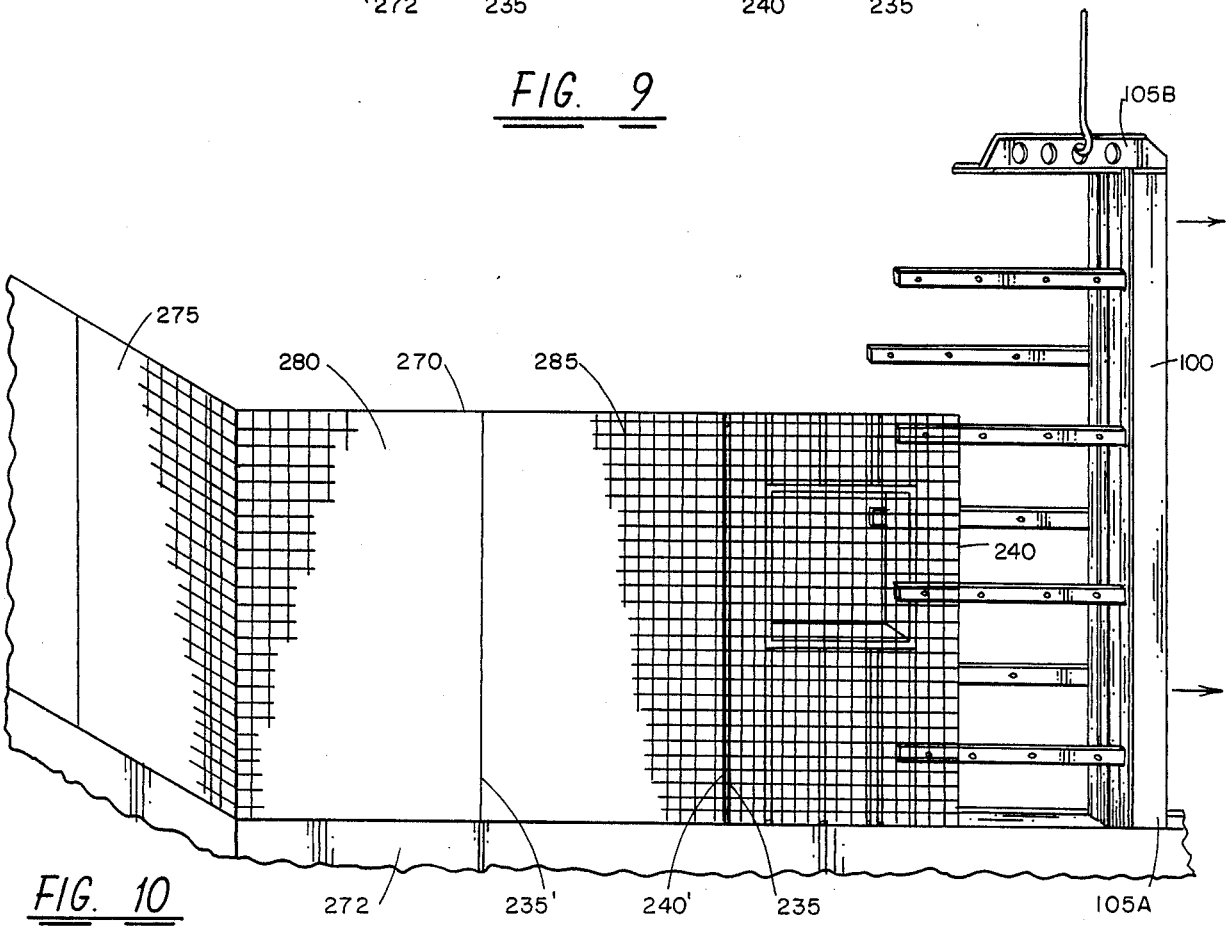
FIG. 10 is a perspective view of the panel fixture being withdrawn from the panel after such panel positioned in the modular building.

The portions of wire mesh sheets 255 and 260 which overlap with the wire mesh sheets of adjacent panels are connected to the wire mesh sheets of such panels by using "hog clips", welding or other connecting devices. Once panel 250 is fixed in position, as shown in FIG. 10, fixture 100 is horizontally withdrawn from panel 250 for use in constructing the next panel which is then attached to boundary 240 of panel 250.

When the walls of building 270 are thus constructed panel by panel, fluent concrete is applied to both sides of the panels. When the concrete hardens, a wall consisting of an outer layer of concrete, a middle layer of insulative material, and an inner layer of concrete results. Although in the particular example given above, panels 250 are used to fabricate the wall of a building, those skilled in the art will appreciate that the panel fixture, panel structure and panel installation method may also be used to fabricate ceilings, roofs, floors or other surfaces of a building as desired. Furthermore, the inner surface may be coated with materials other than concrete.

Figure 11:
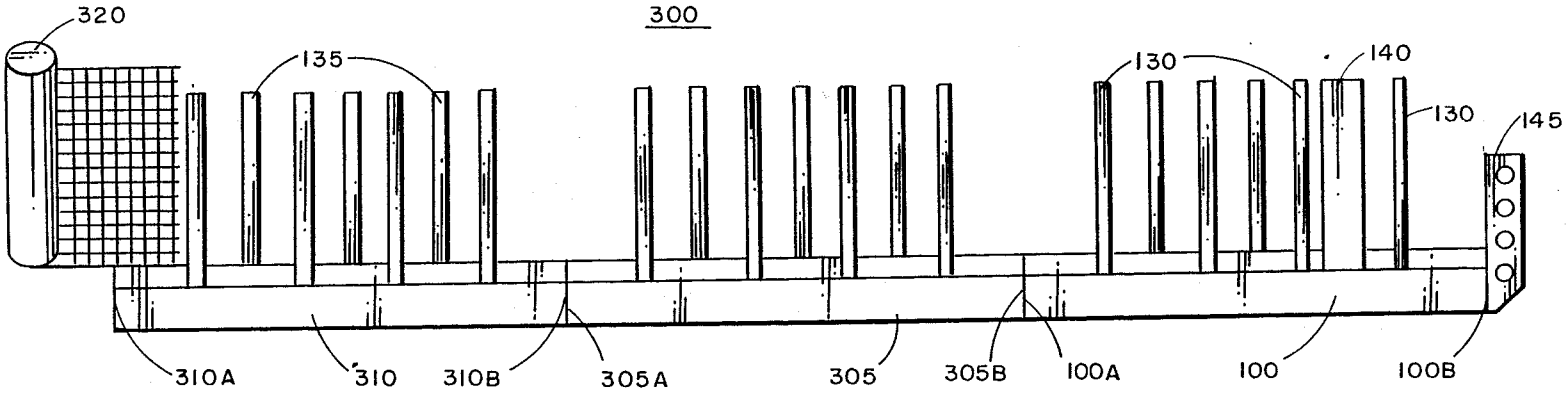
FIG. 11 is a side view of an extended panel fixture.

FIG. 11 is a side view of a modified panel fabrication fixture 300 which is capable of fabricating panels substantially longer than those panels fabricated using panel fixture 100. Panel fixture 300 is formed from a plurality of panel fixtures situated in end to end relationship and bolted together to form a single unitary structure. That is, panel fixture 300 of FIG. 11 includes a panel fixture 100 from FIG. 2 having opposed ends 100A and 100B as shown in FIG. 11. Panel fixture 300 further includes fixtures 305 and 310 which are substantially similar to fixture 100 except for the modification that hoist attachment member 145 and end piece 140 are not present in fixtures 305 and 310. Fixture 305 includes opposed ends 305A and 305B of which end 305B is bolted to or otherwise fixedly attached to end 100A of fixture 100. Fixture 310 includes opposed ends 310A and 310B of which end 310B is bolted to or otherwise fixedly attached to end 305A thus forming the aforementioned unitary panel fixture 300. Although in the particular embodiment of the invention shown in FIG. 11, three panel fixtures have been used to create a larger fixture, it will be appreciated that the invention is not limited to this number of panels. That is, two, three or more panels may be arranged in end to end relationship and connected according to the above teaching to create panel fixtures for fabricating panels of virtually any length consistent with the strength of materials available.

A roll of wire mesh 320 is situated adjacent end 310A for later use in this factory or assembly line method for assembling long panels. In this manner, when a panel is fabricated in fixture 300 by the layering of insulative blocks and trusses as discussed earlier, wire mesh is drawn from end 310A to end piece 140 to cover the fabricated panel from end to end as later described in more detail.

Figure 12:
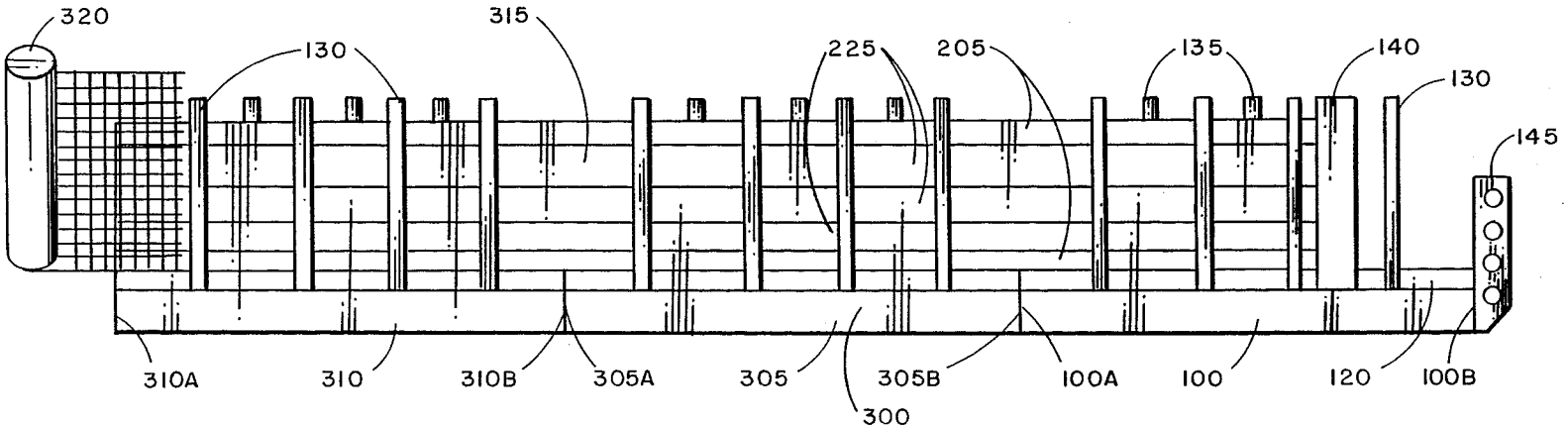
FIG. 12 is a side view of the extended panel fixture of FIG. 11 with insulative blocks installed therein.

As seen in FIG. 12, a long panel 315 is fabricated by installing blocks 205, 225, 225, 225 and 205 layer by layer with trusses 195 (not shown, for clarity) therebetween. Blocks 205 and blocks 225 are sufficiently long to occupy fixture 300 from end 310A to end piece 140. In the same manner as was employed in the fabrication process described with reference to using fixture 100 of FIG. 2, adhesive is applied to adjacent blocks to permit such blocks to adhere one to the other.

Figure 13:
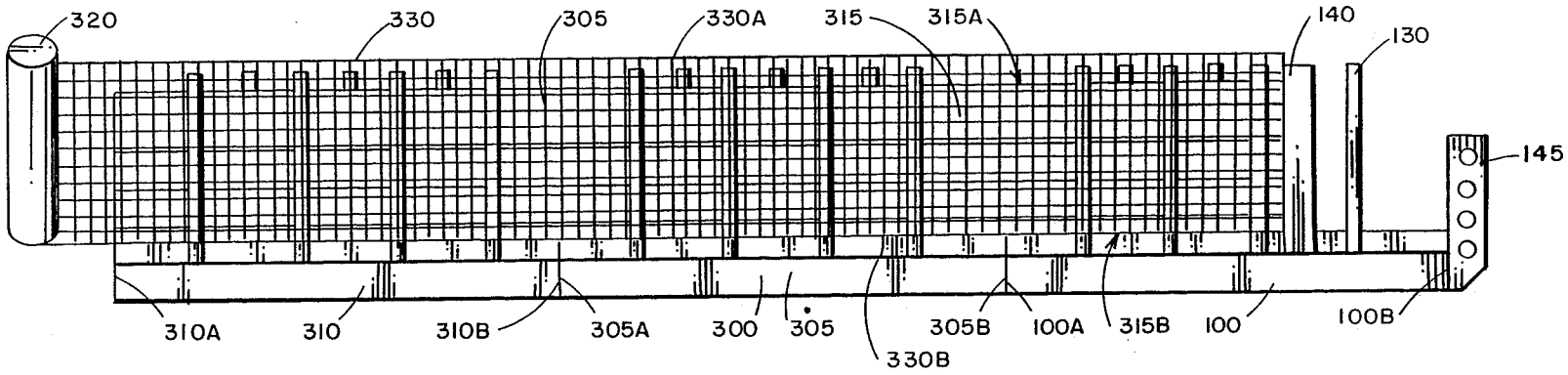
FIG. 13 is a side view of the extended panel fixture of FIG. 12 with a wire mesh installed thereon.

As shown in FIG. 13, after the blocks and trusses are positioned in fixture 300, wire mesh is unrolled from wire mesh roll 320 such that a wire mesh sheet 330 extends between end piece 140 and fixture end 310A. Wire mesh sheet 330 includes an upper edge surface 330A which extends beyond the upper boundary 315A of panel 315 by a sufficient distance to permit substantial overlap with an adjacent panel when panel 300 is installed in a building. Wire mesh sheet 330 includes a lower edge surface 330B which is flush with the lower boundary 315B of panel 315. Wire mesh sheet 330 is secured to the trusses (not shown) of panel 315 in the manner described previously. In the view of FIG. 13, wire mesh sheet 330 is shown mounted on the side of panel 315 facing the viewer of FIG. 13. Another wire mesh sheet, substantially identical to wire mesh sheet 330, is similarly mounted on the side of panel 315 facing away from the viewer. For convenience in installing wire mesh sheets 330, a single wire mesh sheet may be unrolled from starting at end piece 140 on the side of panel 315 facing the viewer and extending to end 310A and doubling back across the side of panel 315 facing away from the viewer to end piece 140.

Long panel 315 is then hoisted into position in the building under construction in substantially the same manner as was employed for panel fixture 100 of FIG. 2. Cement is applied as before to achieve the finished building product. In this factory approach to building modular concrete structures, since larger panels are easily fabricated using the modified long fixture 300, correspondingly larger buildings are more easily and more quickly fabricated. It therefore may be desirable to remove the panels 315 from the fixture 300 without raising the fixture. An overhead crane (not shown) or other hoisting apparatus may be used to lift the panel 315 from the fixture 300 and to transport the panel.

Figure 14:
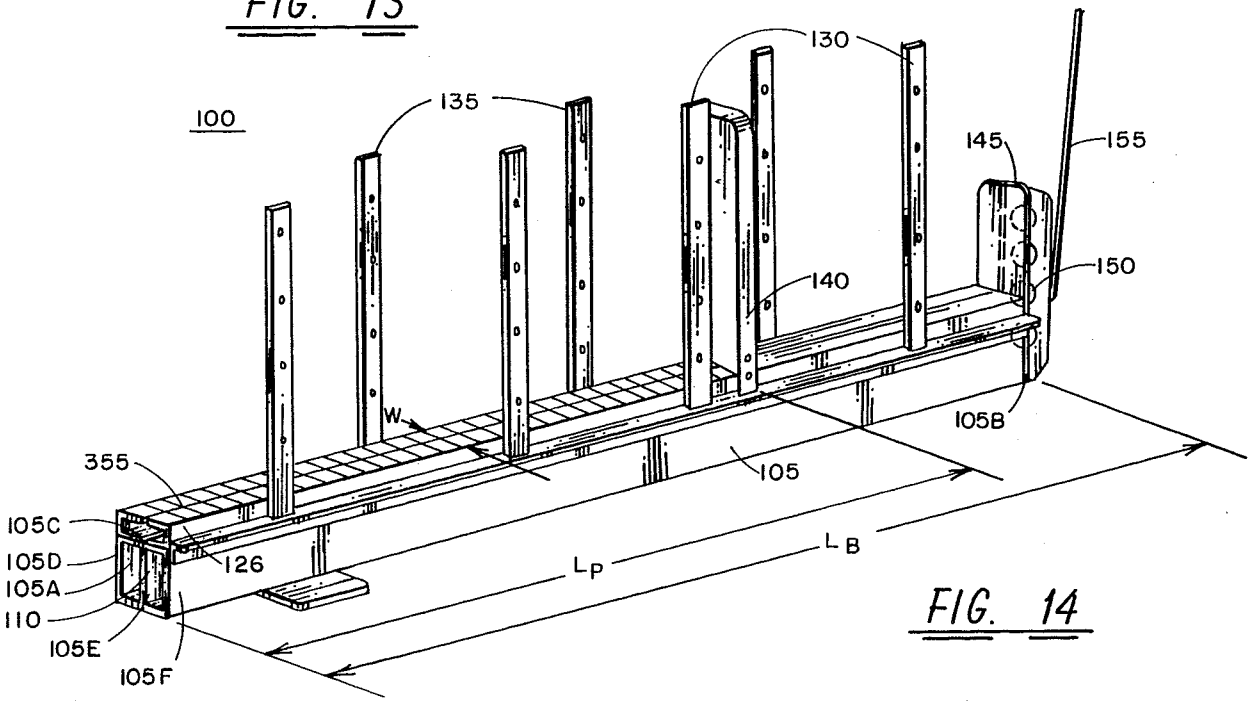
FIG. 14 is a side view of the panel fixture of FIG. 2 being prepared for fabrication of an adhesiveless panel structure.
Figure 15:
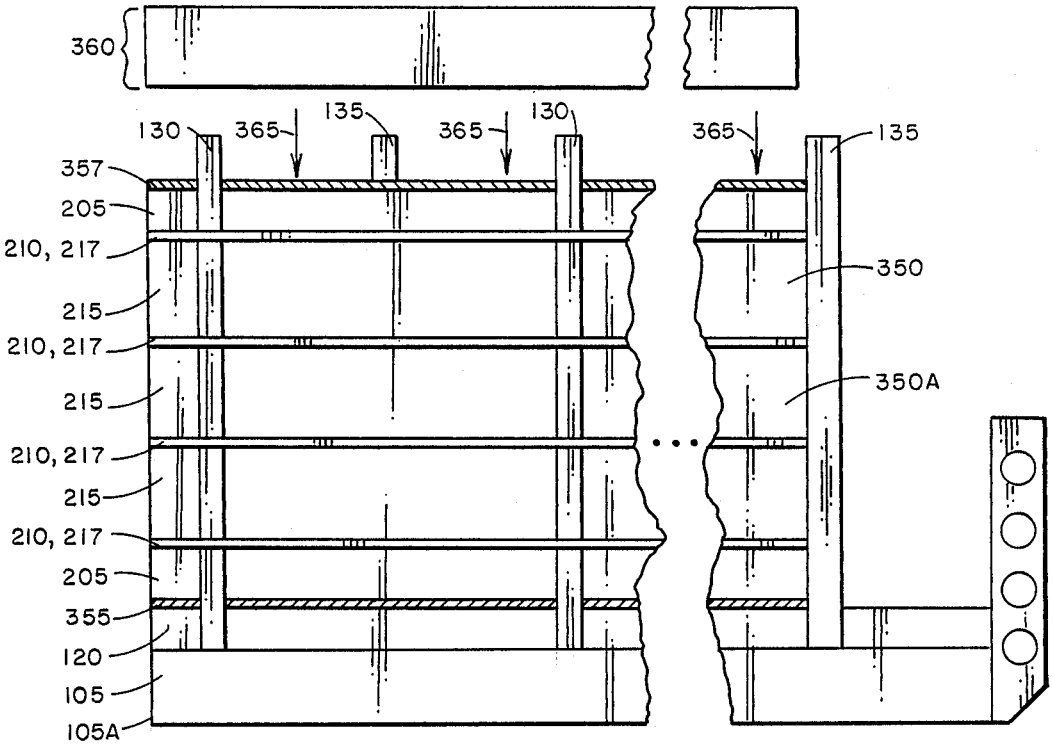
FIG. 15 is a side view of an adhesiveless panel situated in the panel fixture of FIG. 14.
Figure 16:
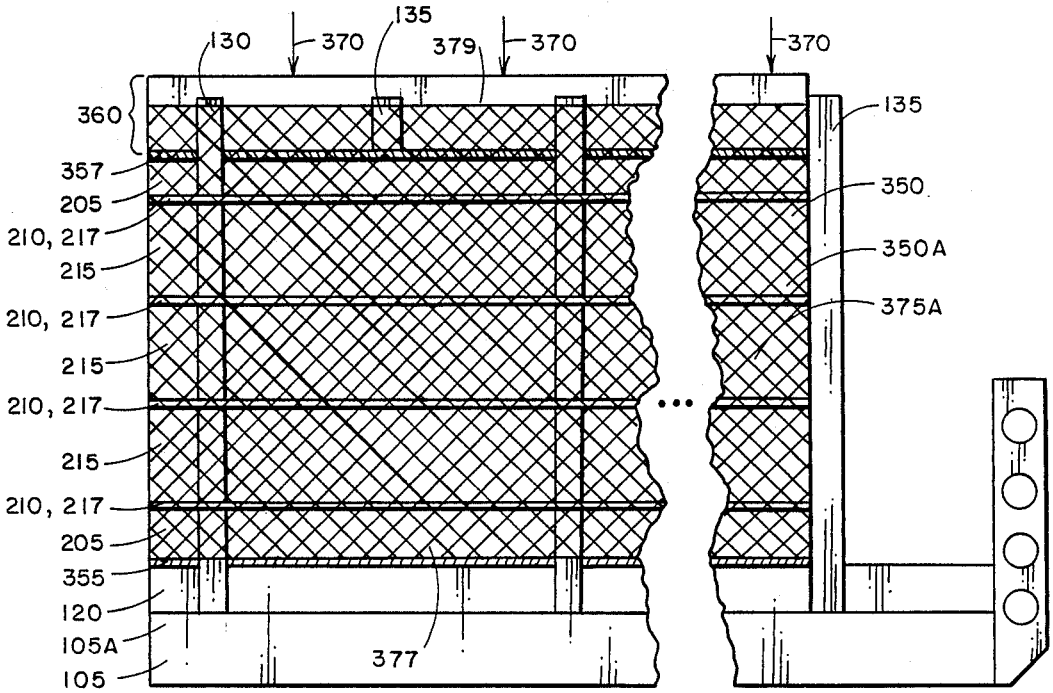
FIG. 16 is a side view of the panel and fixture of FIG. 15 shown under compression by a press beam.

FIG. 14 shows an alternative way of fabricating a modular panel using panel fixture 100 and which avoids the use of adhesive. The panel fabricated according to the method illustrated in FIGS. 14–16 is referred to as panel 350. Fabrication of panel 350 is commenced by situating a lower wire mesh sheet 355 in fixture 100 between rows of staves 130 and 135 as shown. Wire mesh sheet 355 exhibits a width W which is the distance between rows 130 and 135. Wire mesh sheet 355 further exhibits a length LP which is the distance between beam end 105A and end piece 140. LP corresponds to the length of panel 350 when fabricated. W corresponds approximately to the width of panel 350 when fabricated although the actual width of panel 350 will be somewhat wider than W as will be seen subsequently.

At this point, fabrication of panel 350 continues in the same manner as in the fabrication of the modular panel shown in FIGS. 2–7, except that no adhesive layers are applied between the insulative blocks of the panel under construction. The panel structure 350 shown in FIG. 15 thus results. That is, panel 350 from bottom to top includes the following elements: lower wire mesh sheet 355, insulative block 205, truss 210 of which stringer 217 is visible, block 215, truss 210, block 215, truss 210, block 215, truss 210 and block 205. An upper wire mesh sheet 357 substantially the same as lower wire mesh sheet 355 is situated above block 205 as shown in FIG. 15. The panel 350 thus formed includes a front surface 350A which is visible to the viewer of FIG. 15 and a back surface opposed to surface 350A and which is not visible and faces away from the viewer.

Once panel 350 is assembled in the manner indicated above, a press beam 360 is positioned at the top of fixture 100 above upper wire mesh sheet 357 and as shown in FIG. 15. Beam 360 is lowered in the direction indicated by arrows 365 in FIG. 15 until beam 360 is in contact with wire mesh sheet as shown in FIG. 16. Referring now to FIG. 16, downward force is applied to press beam 360 in the direction indicated by arrows 370 to compress the elements of panel 350 together. Alternatively, beam 360 is sized to have sufficient weight by itself to compress the elements of panel 350 together when positioned as shown in FIG. 16.

While the elements of panel 350 are under compression as above, a front wire mesh sheet 375A is positioned on panel front surface 350A. Front wire mesh sheet 375A includes a lower edge 377 which is situated substantially flush with wire mesh sheet 355 and is connected thereto by a plurality of hog clips or other mechanical connecting devices (not shown) situated along the lengthwise dimension of sheet 355. Also, while the elements of panel 350 are under compression, a back wire mesh sheet 375B (not shown) substantially identical to the above described front wire mesh sheet 375A is positioned on the back surface of panel 350. The lower edge of the back wire mesh sheet 375B (not shown) is connected to wire mesh sheet 355 in the same manner as front wire mesh sheet 375A.

Front mesh sheet 375A includes an upper edge 379 which extends beyond the top of uppermost block 205 and upper wire mesh sheet 357 so as to overlap an adjacent panel when completed panel 350 is ultimately used to fabricate a modular building. Likewise, the back wire mesh sheet 375B (not shown) includes a lower edge which extends beyond the bottom of lowermost block 205 for panel overlap purposes.

With the elements of panel 350 are still under compression, upper wire mesh sheet 357 is connected to the front and back wire mesh sheets, 375A and 375B, in the same manner that lower wire mesh sheet 355 was connected thereto. With the panel 350 still under compression and with the front and back wire mesh sheets 375A and 375B positioned as indicated above, front and back sheets 375A and 375B are connected to the stringers of trusses 210 at a plurality of locations along the dimension of each of stringers 210.

With panel 350 thus assembled, press beam 360 is removed from fixture 100. Panel 350 may now be employed to fabricate a building using the same technique illustrated in FIGS. 8-10 and described in the corresponding description above.

Although in the example given above, panel 350 is fabricated in a single panel fixture 100, it will be appreciated that the same method may be applied to fabricate longer panels by using the extended panel fixture of FIG. 11. The panel fixture of FIGS. 15 and 16 is drawn with a broken region to indicate that any number of panel fixtures may be bolted together as in FIG. 11 to enable fabrication of long panels of desired length.

Figure 17:
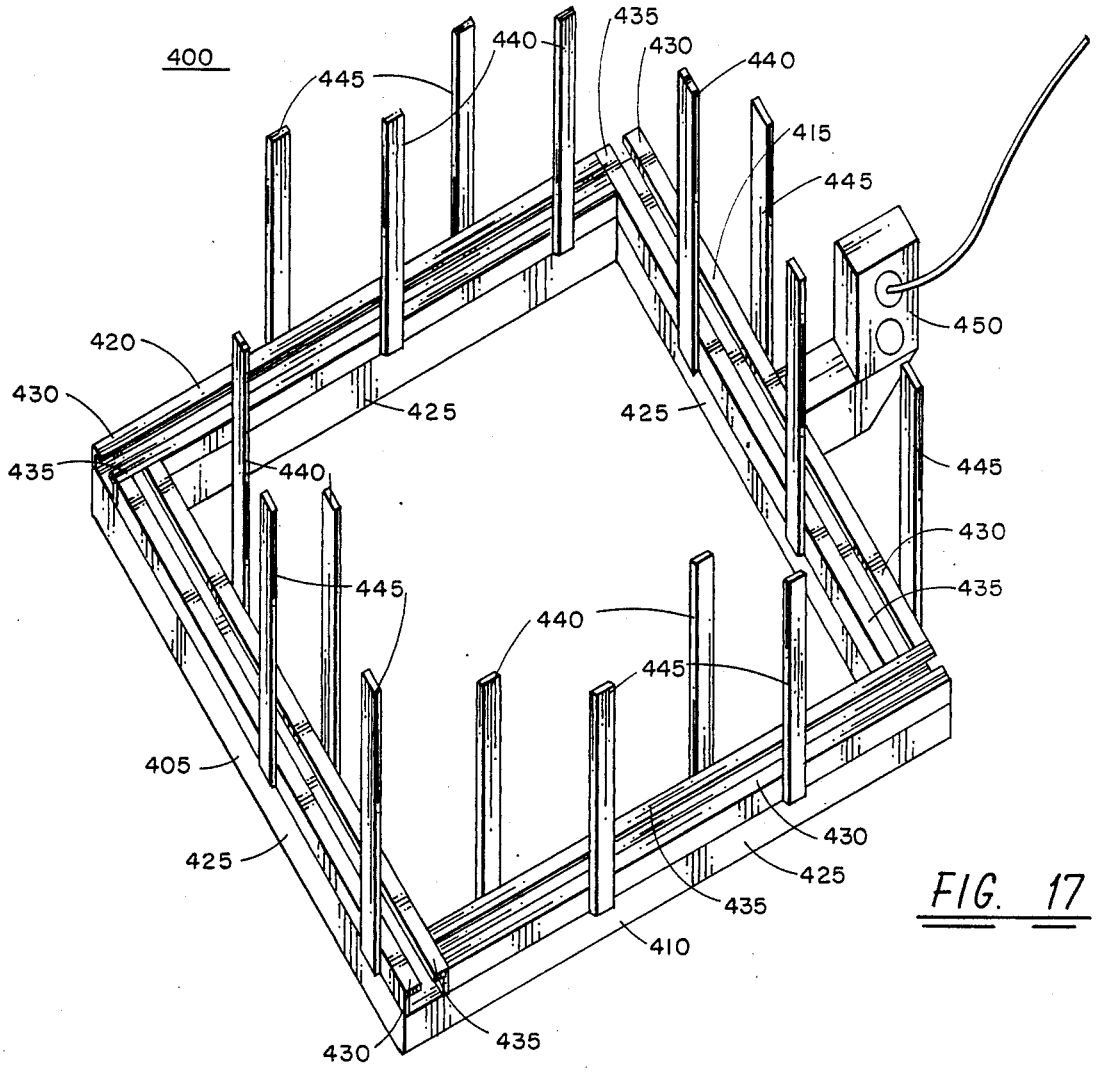
FIG. 17 is a top perspective view of a four sided panel structure.

FIG. 17 shows a panel fixture 400 which is used to fabricate a four walled modular panel structure. Fixture 400 is made of many of the same parts as fixture 100 described earlier as will be seen subsequently. Fixture 400 includes four substantially similar sub-fixtures 405, 410, 415, 420. Sub-fixtures 405, 410, 415 and 420 each include a base 425 which is similar to beam 105. The four bases 425 are arranged perpendicular with respect to each other and in end to end relationship as seen in FIG. 17 so as to form a substantially square base structure. Each of bases 425 of fixture 400 have U-channel members 430 and 435 mounted thereon in a fashion similar to U-channel members 115 and 120 of fixture 100. U-channel members 430 and U-channel members 435 perform the same function as U-channel members 115 and 120, respectively, namely accommodating different width insulative blocks. A row of staves 440 and a row of staves 445 are mounted on U-channel members 435 and 430, respectively, of each of sub-fixtures 405, 410, 415 and 420 as shown in FIG. 17. A hoist attachment member 450 is attached to sub-fixture 415 to facilitate the hoisting of a completed panel assembly into position in a building under construction.

Figure 18:
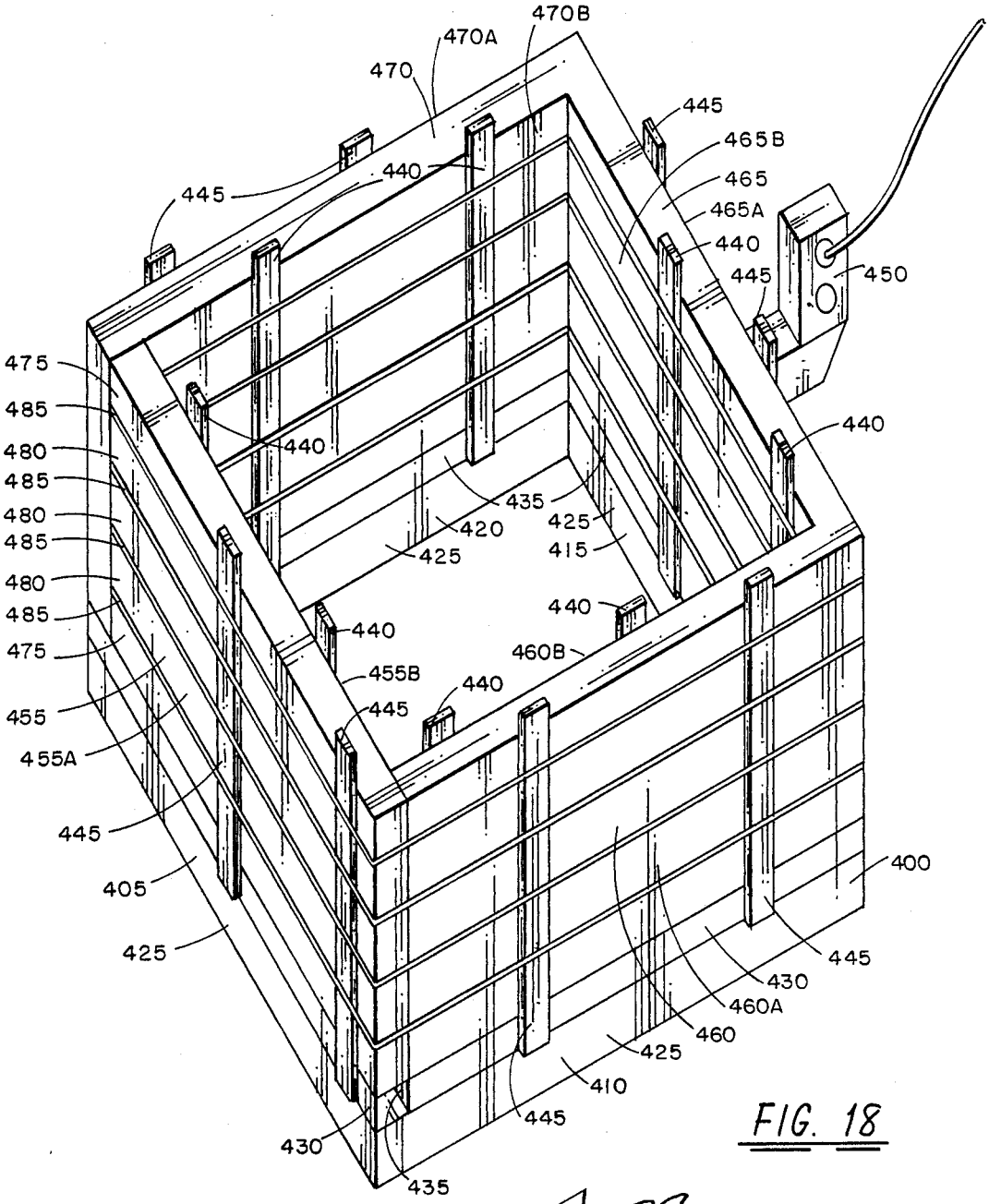
FIG. 18 is a top perspective view of the four sided panel structure of FIG. 17 shown filled with insulative blocks and trusses.

As seen in FIG. 18, panels 455, 460, 465 and 470 are built up in sub-fixtures 405, 410, 415 and 420, respectively, in a layer by layer manner similar to that by which a panel was fabricated in fixture 100 as described earlier in the discussion of FIGS. 2–7. That is, taking panel 455 in sub-fixture 405 for example, panel 455 is built up by placing the following elements in sub-fixture 405 from bottom to top thereof: insulative block 475, truss 485, block 480, truss 485, block 480, truss 485, block 480, truss 485 and finally another block 475 on top. Blocks 475, blocks 480 and truss 485 are substantially similar to blocks 205, blocks 225 and truss 210 of FIG. 5 except the length of these blocks and trusses are appropriately dimensioned to fit within sub-fixture 455. In the same manner as the structure of FIG. 5, adhesive layers are laid down at the surfaces of blocks 475 and 485 where such blocks contact each other.

Panels 460, 465 and 470 in sub-fixtures 410, 415 and 420 are fabricated in substantially the same manner as panel 455 in sub-fixture 405 described above. It is noted that the present invention is not limited to fabricating square modular panel structures as in FIG. 18. Alternatively, for example, a rectangular panel structure is readily formed by employing sub-fixtures 405 and 415 which are of equal length and longer than the length of sub-fixtures 410 and 420.

The four walled square modular panel structure thus far formed includes a panel 455 having opposed inner and outer surfaces 455A and 455B, a panel 460 having opposed inner and outer surfaces 460A and 460B, a panel 465 having opposed inner and outer surfaces 465A and 465B and a panel 470 having opposed inner and outer surfaces 470A and 470B. For reference, it is noted that in FIG. 18, only the stringers of trusses 485 are visible.

Figure 19:
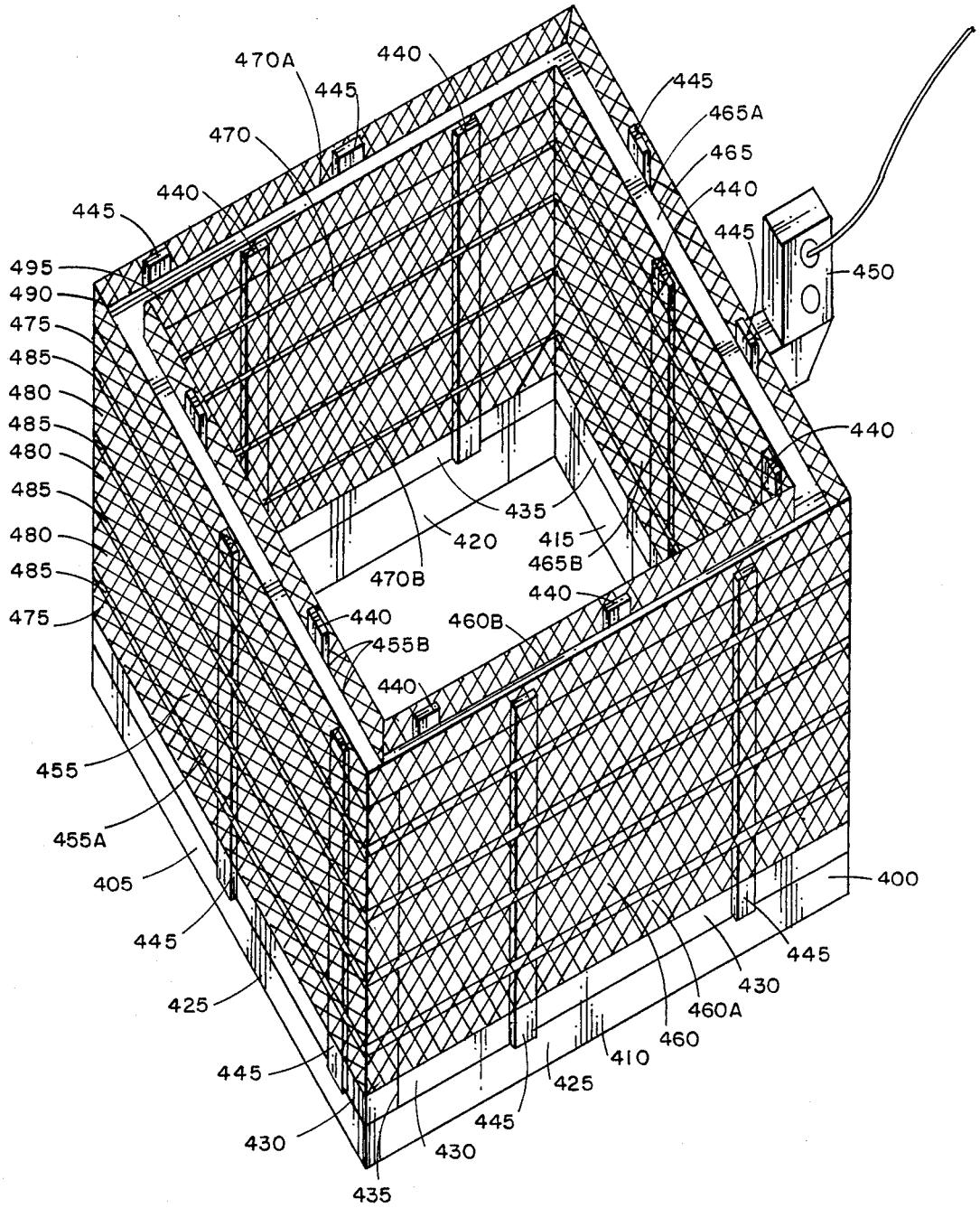
FIG. 19 is a top perspective view of the four sided panel structure of FIG. 18 shown with wire mesh installed on the major surfaces thereof.

Fabrication of the four walled modular panel structure continues by installing an outer mesh sheet 490 around outer panel surfaces 455A, 460A, 465A and 470A as shown in FIG. 19. Outer mesh sheet 490 is preferably one continuous mesh sheet surrounding outer panel surfaces 455A, 460A, 465A and 470A. At the ends of such continuous wire mesh sheet 490, where sheet 490 closes on itself, the ends of sheet 490 are connected together by "hog clips" or other connecting devices for coupling mesh together. An inner mesh sheet 495 is installed around inner panel surfaces 455B, 460B, 465B and 470B also as shown in FIG. 19. Preferably, inner mesh sheet 495 is one continuous sheet, the ends of which are mechanically connected together, for example by "hog clips" or similar connecting devices. For purposes of this example, trusses (more specifically, the stringers thereof) have been shown only on outer panel surface 455, although from the earlier description it will be appreciated that the inner and outer surfaces of panels 455, 460, 465 and 470 each have stringers thereon. It is to these stringers on outer surfaces 455A, 460A, 465A and 470A that outer mesh sheet 490 is connected by "hog clips" or other connecting devices as discussed earlier. Preferably, outer mesh sheet 490 is connected at regular intervals along the length of each stringer which contacts outer sheet 490. Similarly, inner mesh sheet 495 is connected at regular intervals along the length of each stringer which contacts inner mesh sheet 495.

It is noted that in a manner similar to that employed in fixture 100, in four sided panel fixture 400 the bottom edges of outer mesh sheet 490 and inner mesh sheet 495 are situated flush with respect to U-channel members 430-435 in sub-fixtures 405, 410, 415 and 420. Also, in a manner similar to that employed in fixture 100, in four sided panel fixture 400 the top edges of outer mesh sheet 490 and inner mesh sheet 495 extend beyond the top of upper block 475 to permit overlap and connection with the corresponding mesh sheets of adjacent four sided panel structures in a building under construction.

Figure 20:
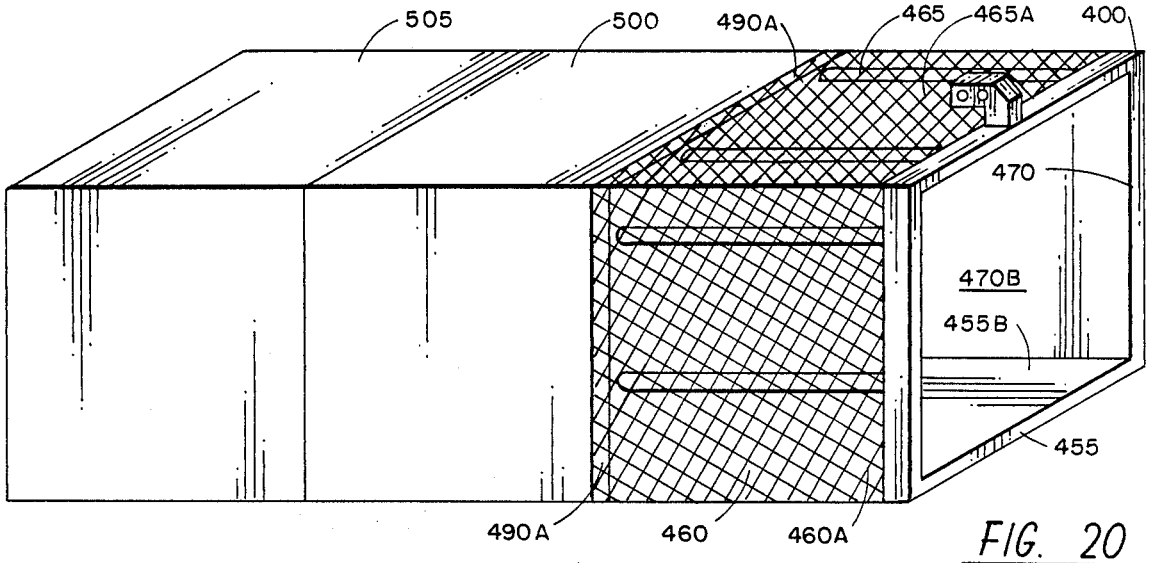
FIG. 20 is a side perspective view of the four sided panel structure of FIG. 19 shown arranged in end to end relationship with other four panel structures to form a portion of a building.

To actually fabricate a building using fixture 400, fixture 400 with a completed four sided panel modular structure therein is hoisted, rotated 90 degrees and positioned in side by side relationship with other such four sided panel structures which have already been positioned as shown in FIG. 20. Thus, in this particular example, panels 455, 460, 465 and 470 become the floor, near wall, ceiling and far wall, respectively, of the building portion depicted in FIG. 20. The overlapping portion 490A of outer mesh sheet 490 is connected by "hog clips" or other connecting devices to the wire mesh (not shown) of an adjacent four panel structure 500. Four panel structure 500 is shown adjacent another four panel structure 505. By continuing this process as described above, multiple four panel structures can be stacked side by side to form a tunnel-like or tubular structure. It will be appreciated that multiple tunnel structures as described above can be positioned side by side or one on top of the other to form buildings of many different configurations. When the desired building configuration is achieved, fluent concrete is applied to the wire mesh sheets of the respective panels of the building. When the concrete hardens, four wall structures having significant structural integrity and enhanced insulative properties result.

Figure 21:
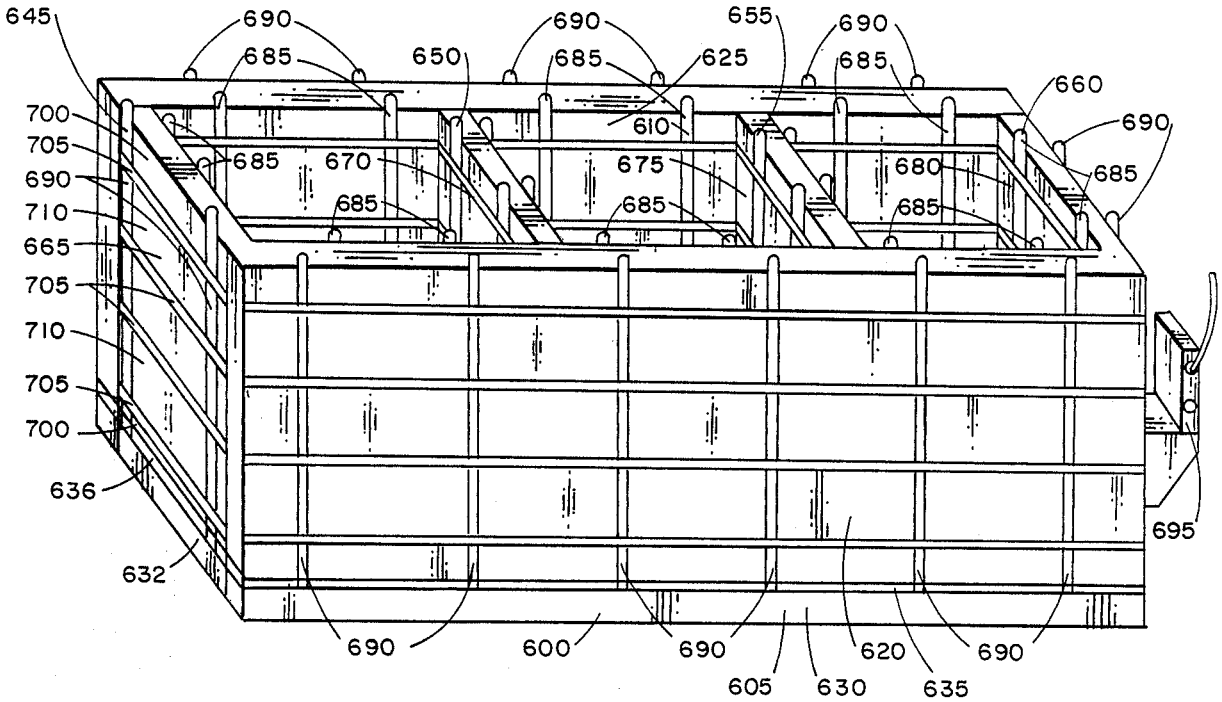
FIG. 21 is a side perspective view of a three chamber panel fixture shown with insulative blocks and trusses installed therein.

Alternatively, a plurality of tube-like or tunnel-like multi-panel structures can be fabricated simultaneously using panel fixture 600 shown in FIG. 21. Fixture 600 is made of many of the same parts as fixtures 100 and 400 described earlier as will be seen subsequently. Fixture 600 includes a front sub-fixture 605 and a back sub-fixture 610 for fabricating a front panel 620 and a back panel 625, respectively, as seen in FIG. 21. Sub-fixtures 605 and 610 are oriented substantially parallel with respect to each other. It will be assumed that sub-fixtures 605 and 610 exhibit a length of 30 feet for purposes of this example although in actual practice such length is in no way limited to this value and may vary as appropriate for the size structure desired. Sub-fixtures 605 and 610 each include a beam 630 which forms the base of each sub-fixture. Two U-channel members of which member 635 is visible in FIG. 21, are situated on the respective beams 630 of sub-fixtures 605 and 610. These two U-channel members perform substantially the same function as U-channel members 115 and 120 of FIG. 2 and U-channel members 430 and 435 of FIG. 17.

Fixture 600 further includes four substantially similar cross sub-fixtures 645, 650, 655 and 660 which are each oriented substantially perpendicular with respect to sub-fixtures 605 and 610. Sub-fixtures 645, 650, 655 and 660 are arranged in ladder-like fashion with respect to substantially parallel sub-fixtures 605 and 610. Sub-fixtures 645, 650, 655 and 660 are employed to fabricate end panel 665, middle panel 670, middle panel 675 and end panel 680, respectively. Sub-fixtures 645, 650, 655 and 660 are substantially similar to sub-fixtures 605 and 610 except that in the embodiment shown, sub-fixtures 645, 650, 655 and 660 are somewhat smaller than sub-fixtures 605 and 610. Also, sub-fixtures 645, 650, 655 and 660 include beams 632 which form the base of such sub-fixtures. First and second U-channel members such as member 636 are situated on each of beams in accordance with the earlier description. In this particular example, sub-fixtures 645, 650, 655 and 660 are laterally mounted between sub-fixtures 605 and 610 at regular intervals. Other embodiments of the invention are contemplated where such cross sub-fixtures are mounted at different intervals in fixture 600. However, for purposes of this example, it will be assumed that cross-fixtures are laterally mounted between sub-fixtures 605 and 610 at regular spacing intervals of ten feet. It will be appreciated that this particular spacing value is in no way limiting and that the spacing interval of cross-fixtures will vary according to the particular modular panel spacing desired for the specific building to be constructed.

A row of staves 685 and a row of staves 690 are mounted on the two U-channel members, respectively, of each of sub-fixtures 605, 610, 645, 650, 655 and 660 as shown in FIG. 21. A hoist attachment member 695 is attached to sub-fixture 415 to facilitate the hoisting of a completed panel assembly into position under construction.

As seen in FIG. 21, panels 620, 625, 665, 670, 675 and 680 are built up in sub-fixtures 605, 610, 645, 650, 655 and 660, respectively, in a layer by layer manner similar to that by which a panel was fabricated in fixture 100 as described earlier in the discussion of FIGS. 2–7. That is, taking end panel 665 in sub-fixture 645 for example, panel 665 is built up by placing the following elements in sub-fixture 645 from the bottom to the top thereof: insulative block 700, truss 705, block 710, truss 705, block 710, truss 705, block 710, truss 705 and finally another block 700 on top. Blocks 700, blocks 710 and truss 705 are substantially similar to blocks 205, blocks 225 and truss 210 of FIG. 5 except the lengths of these blocks and trusses are appropriately dimensioned to fit within sub-fixture 645. In the same manner as the structure of FIG. 5, adhesive layers are laid down at the surfaces of blocks 700 and 710 where such blocks contact each other. Panels 620, 625, 670, 675 and 680 are built up in sub-fixtures 605, 610, 650, 655 and 660 in substantially the same manner as panel 665 in sub-fixture 645 described above.

Figure 22:
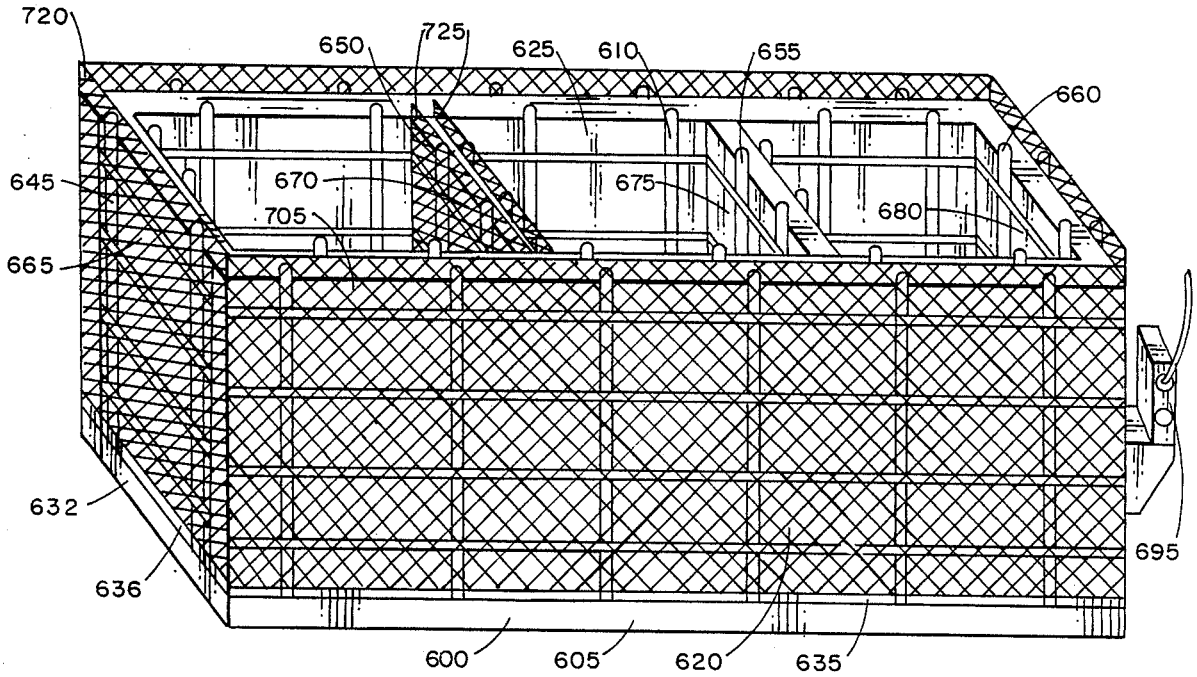
FIG. 22 is a side perspective view of the three chamber panel structure of FIG. 21 shown with wire mesh sheets installed thereon.

An outer wire mesh sheet 720 is wrapped around the outer surface sub-fixtures 645, 605, 660 and 610 of fixture 600. Wire mesh sheet 720 is secured to panels 665, 620, 680 and 625 in substantially the same manner as sheet 490 in FIG. 19. Wire mesh sheet 720 is mounted flush with the top of U-channels 635 and 636 and extends beyond the top surface of the uppermost insulative block 705 to permit overlap with adjacent modules in a building under construction as with the earlier embodiments already discussed. To preserve clarity in the drawing of FIG. 22, all of the wire mesh sheets which are applied to the remaining surfaces of the respective panels on fixture 600 are not shown. However, each of the opposed major surfaces of the panels of FIG. 22 is preferably provided with a wire mesh sheet which is "hog clipped" or otherwise connected to the stringers of that panel as well as adjacent wire mesh sheets. For example, the opposed major surfaces of panel 670 in fixture 650 are shown with respective wire mesh sheets 725 thereon.

Figure 1:
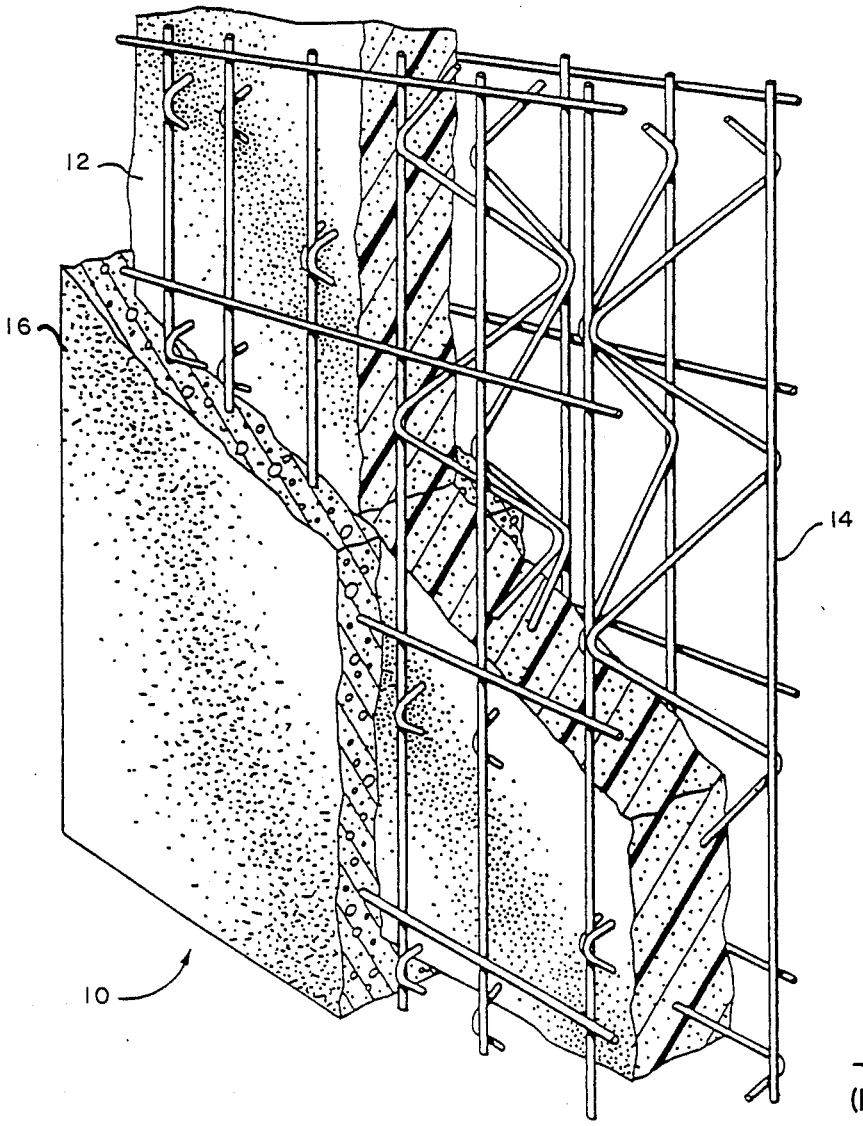
FIG. 1 (PRIOR ART)
FIG. 1 is a side perspective view of a conventional reinforced insulative foam/wire matrix panel which may be used in a modular concrete building.
Figure 23:
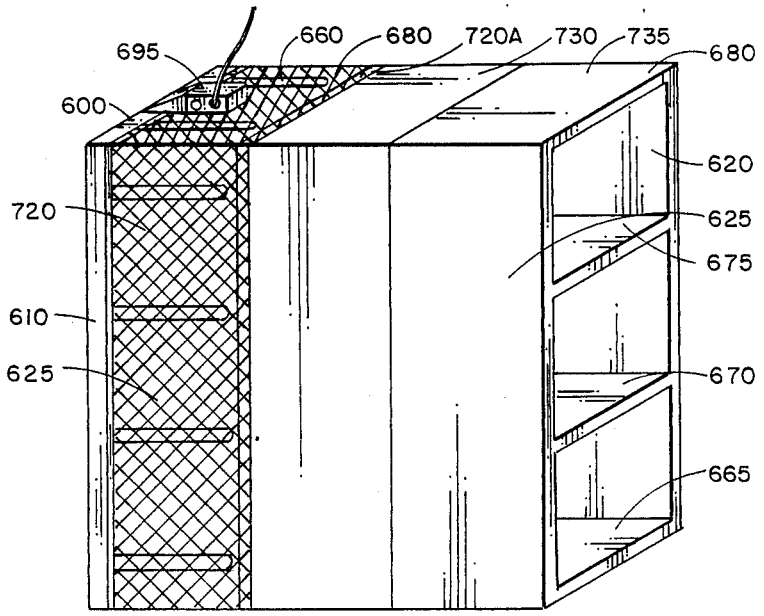
FIG. 23 is a side perspective view of the three panel structure of FIG. 22 shown arranged in end to end relationship with other three chamber structures to form a portion of a building.

To actually fabricate a building using fixture 600, fixture 600 with a completed three chamber modular structure therein is hoisted via hoisting attachment 695, rotated 90 degrees and positioned in side by side relationship with other such three chamber panel structures which have already been positioned as shown in FIG. 23. Like numerals are used on such already positioned panel structures to indicate like elements Thus, in this particular example, panels 665, 670, 675 and 680 become ceiling and floors. Panels 620 and 625 become walls of the building portion depicted in FIG. 23. The overlapping portion 720A of outer mesh sheet 720 is connected by "hog clips" or other connecting devices to the wire mesh of an adjacent three chamber modular structure 730. Three chamber panel structure 730 is shown adjacent another three chamber panel structure 735. By continuing this side by side connection process as described above, multiple three chamber panel structures can be stacked side by side to form a multiple tunnel or multiple tube structure. When the desired configuration is achieved and when the fixture has been removed from the panel structure, fluent concrete is applied to the wire mesh sheets of the respective panels. When the concrete hardens, three chamber structures with and substantial structural integrity and insulative properties result. It will be appreciated that multiple tunnel or multiple tube structures as described above can be positioned side by side to form buildings of many different configurations.

Although in the embodiments of the invention discussed above, both major surfaces of each panel fabricated have had wire mesh sheets thereon to which fluent concrete is applied, embodiments of the invention are contemplated wherein only one of the two major surfaces has a wire mesh sheet thereon to which fluent concrete is applied.

The foregoing describes apparatus for fabricating modular panels at a construction site. The apparatus and method disclosed provides for both fabrication of such panels and placing such panels in position in the building to be constructed. Panels with substantial structural integrity and increased insulative properties result.

While only certain preferred features of the invention have been shown by way of illustration, many modifications and changes will occur to those skilled in the art. It is, therefore, to be understood that the present claims are intended to cover all such modifications and changes which fall within the true spirit of the invention.

I claim:

1. A fixture apparatus for assembling composite concrete panels comprising:

a base member having a lateral dimension;

a first row of staves situated in spaced apart relationship and being mounted to said base member along the lateral dimension thereof and extending away from said base member;

a second row of staves situated in spaced apart relationship and being mounted to said base member along the lateral dimension thereof and extending away from said base member, the staves of said second row being oriented generally parallel with and spaced apart from the staves of said first row such that said fixture is capable of engaging insulative blocks between said first and second rows of staves.

2. The apparatus of claim 1 wherein said fixture further includes:

first mounting means, attached to said base member and said first row of staves, for movably mounting said first row of staves with respect to said base member; and second mounting means, attached to said base member and said second row of staves, for movably mounting said second row of staves with respect to said base member, whereby said first and second rows of staves are movable closer together to accommodate insulative blocks therebetween having smaller lateral thickness and said first and second rows of staves are movable farther apart to accommodate insulative blocks therebetween having larger lateral thickness.

3. A fixture apparatus for assembling composite concrete panels comprising:

a base member having first and second opposed surfaces;

a first support member oriented adjacent and generally parallel with respect to said first surface;

a second support member oriented adjacent and generally parallel with respect to said second surface;

a first row of staves being situated in spaced apart relationship and mounted to said first support member so as to extend away from said base member;

a second row of staves being situated in spaced apart relationship and mounted to said second support member and extending away from said base member, said second row of staves being oriented generally parallel with respect to said first row of staves; and said first and second support members being movably mounted to said base member such that said first and second rows of staves may be moved closer together or farther apart as necessary to accommodate insulative blocks of different lateral thickness therebetween.

4. The fixture apparatus of claim 3 wherein said first and second support member are U-channel members which are boltable to said base member in a plurality of different positions corresponding to different distances between said first and second rows of staves.

5. A method for fabricating a composite concrete panel in a fixture having a first row of spaced apart staves attached to a base member and a second row of spaced apart staves attached to said base member, said first row being substantially parallel with said second row, an insulative block receiving region being formed above said base member and between said first and second rows, said method comprising the steps of:

placing a block of insulative material in said block receiving region;

situating a truss in the block receiving region of said fixture above said block, said truss having parallel stringer members connected together by a plurality of cross members, the stringer members of said truss being situated outside of said first and second row of staves;

applying adhesive to said block;

repeating said placing, situating and applying steps until nearly the desired panel height is achieved;

placing a block of insulative material in said block receiving region to position the uppermost block of said panel and form the top of said panel, the bottom of said panel thus being formed at the lowermost block thereof, the panel thus formed including first and second opposed major surfaces; and mounting first and second wire mesh sheets on the first and second major surfaces of said panel, respectively, one of said first and second wire mesh sheets being substantially flush with the bottom of said panel and extending beyond the top of said panel to permit overlap with other panels, said first and second wire mesh sheets being mounted to the stringer members of the trusses in said panel.

6. The method of claim 5 and including the further steps of:

moving the panel formed according to the above steps into position in a building under construction;

removing said fixture from said panel; and applying fluent concrete to the panel formed according to the above steps.

7. A fixture apparatus for assembling composite concrete panels comprising:

a plurality of sub-fixtures each having opposed ends, said sub-fixtures being arranged in end to end relationship and including adjacent ends which are fixedly connected together, each sub-fixture including:

a base member having a lateral dimension;

a first row of staves situated in spaced apart relationship and being mounted to said base member along the lateral dimension thereof and extending away from said base member;

a second row of staves situated in spaced apart relationship and being mounted to said base member along the lateral dimension thereof and extending away from said base member, the staves of said second row being oriented generally parallel with and spaced apart from the staves of said first row such that said fixture is capable of engaging insulative blocks between said first and second rows of staves; and the first rows of staves of each of said sub-fixtures being in substantial alignment and the second rows of staves of each of said sub-fixtures being in substantial alignment whereby insulative blocks may be captivated between said aligned first rows and said aligned second rows of said plurality of sub-fixtures.

8. A method for fabricating a composite concrete panel in a fixture having a first row of spaced apart staves attached to a base member and a second row of spaced apart staves attached to said base member, said first row being substantially parallel with said second row, an insulative block receiving region being formed above said base member and between said first and second rows, said method comprising the steps of:

positioning at the bottom of said block receiving region adjacent said base member a first wire mesh sheet having a width approximately equal to the lateral thickness of said panel, said first wire mesh sheet forming the bottom of said panel;

placing a block of insulative material in said block receiving region;

situating a truss in the block receiving region of said fixture above said block, said truss having parallel stringer members connected together by a plurality of cross members, the members of said truss being situated outside of said first and second row of staves;

repeating said placing and situating steps until nearly the desired panel height is achieved;

compressing said panel; and mounting second and third wire mesh sheets on the opposed major surfaces, respectively, of said panel with one of said second and third wire mesh sheets having one edge substantially flush with the bottom of said panel and another edge extending beyond the top of said panel to permit overlap with other panels, said second and third wire mesh sheets being mounted to said stringer members for maintaining said blocks in the compressed position.

9. The method of claim 8 and including the steps of:

moving said panel formed according to the above steps into position to forming a portion of a building;

removing said fixture from said panel; and applying fluent concrete to the panel formed according to the above steps.

10. A fixture apparatus for assembling multi-panel composite concrete structures comprising:

first, second, third and fourth sub-fixtures, each having opposed ends which are arranged in end to end relationship to form a rectangle, each sub-fixture including:

a base member having a lateral dimension;

a first row of staves situated in spaced apart relationship and being mounted to said base member along the lateral dimension thereof and extending away from said base member; and a second row of staves situated in spaced apart relationship and being mounted to said base member along the lateral dimension thereof and extending away from said base member, the staves of said second row being oriented generally parallel with and spaced apart from the staves of said first row such that said fixture is capable of engaging insulative blocks between said first and second rows of staves.

11. A method for fabricating a multi-panel composite concrete structure in a fixture having first, second, third and fourth sub-fixtures arranged in end to end relationship to form a rectangle, each of said sub-fixtures having a first row of spaced apart staves attached to a base member and a second row of spaced apart staves attached to said base member, said first row being substantially parallel with said second row, an insulative block receiving region being formed above said base member and between said first and second rows of each of said sub-fixtures, said method comprising:

in each of said sub-fixtures performing the following steps:

placing a block of insulative material in said block receiving region;

situating a truss in the block receiving region of said fixture above said block, said truss having parallel stringer members connected together by a plurality of cross members, the stringer members of said truss being situated outside of said first and second rows of staves;

applying adhesive to said block;

repeating said placing, situating and applying steps until nearly the desired panel height is achieved;

placing an uppermost block of insulative material in said block receiving region forming the top of a panel, the bottom of said panel being formed at the lowermost block in said sub-fixture, the panel thus formed including first and second opposed major surfaces;

mounting first and second wire mesh sheets on the first and second major surfaces of each panel the multi-panel structure, one of said first and second wire mesh sheets being substantially flush with the bottom of said multi-panel structure and extending beyond the top of said multi-panel structure to permit overlap with other multi-panel structures, said first and second wire mesh sheets being mounted to the stringer members of the trusses in said multi-panel structure;

moving the multi-panel structure formed according to the above steps into position in a building under construction; and applying fluent concrete to the structure formed according to the above steps.

12. A fixture apparatus for assembling multi-panel composite concrete structures comprising:

first, second, third and fourth and fifth sub-fixtures, each sub-fixture including:

a base member having a lateral dimension;

a first row of staves situated in spaced apart relationship and being mounted to said base member along the lateral dimension thereof and extending away from said base member;

a second row of staves situated in spaced apart relationship and being mounted to said base member along the lateral dimension thereof and extending away from said base member, the staves of said second row being oriented generally parallel with and spaced apart from the staves of said first row such that said fixture is capable of engaging insulative blocks between said first and second rows of staves;

said first and second sub-fixtures being of substantially equal length and oriented substantially parallel with respect to each other;

said third, fourth and fifth sub-fixtures being situated between and substantially perpendicular to said first and second sub-fixtures to connect said first and second sub-fixtures in ladder-like fashion at spaced intervals whereby insulative blocks may be captured between the first rows and the second rows of said sub-fixtures to form a multi-panel composite structure.

13. A method for fabricating a multi-panel composite concrete structure in a fixture having first, second, third, fourth and fifth sub-fixtures arranged in ladder-like fashion to form first and second substantially rectangular tubes, each of said sub-fixtures having a first row of spaced apart staves attached to a base member and a second row of spaced apart staves attached to said base member, said first row being substantially parallel with said second row, an insulative block receiving region being formed above said base member and between said first and second rows of each of said sub-fixtures, said method comprising:

in each of said sub-fixtures performing the following steps:

placing a block of insulative material in said block receiving region;

situating a truss in the block receiving region of said fixture above said block, said truss having parallel stringer members connected together by a plurality of cross members, the stringer members of said truss being situated outside of said first and second rows of staves;

applying adhesive to said block;

repeating said placing, situating and applying steps until nearly the desired panel height is achieved;

placing an uppermost block of insulative material in said block receiving region, thus forming the top of a panel, the bottom of said panel being formed at the lowermost block in said sub-fixture;

abutting the ends of adjacent ones of the panels to form a multi-panel structure in the shape of first and second tubes each having a substantially rectangular cross section, said multipanel structure having an outer major surface, the first and second tubes of said multi-panel structure having an inner surface, upon which are performed the following steps: mounting a first wire mesh sheet around the outer surface of said multi-panel structure, said first wire mesh sheet being substantially flush with the bottom of each panel of said multi-panel structure and extending beyond the top of each panel of said multi-panel structure to permit overlap with other multi-panel structures, said first wire mesh sheet being mounted to the stringer members of the trusses of the panels of said multi-panel structure;

moving the multi-panel structure formed according to the above steps into position in a building under construction;

removing said fixture from said panel; and applying fluent concrete to the panel formed according to the above steps.

* * * * *